US012654968B2

(12) United States Patent
Haraguchi

(10) Patent No.: US 12,654,968 B2
(45) Date of Patent: Jun. 16, 2026

(54) FRICTION TRANSPORT DEVICE AND PAPER SHEET TRANSPORT DEVICE

(71) Applicant: JAPAN CASH MACHINE CO., LTD., Osaka (JP)

(72) Inventor: Kohei Haraguchi, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 0 days.

(21) Appl. No.: 18/843,054

(22) PCT Filed: Jan. 25, 2023

(86) PCT No.: PCT/JP2023/002306

§ 371 (c)(1),
(2) Date: Aug. 30, 2024

(87) PCT Pub. No.: WO2023/181622

PCT Pub. Date: Sep. 28, 2023

(65) Prior Publication Data

US 2025/0197146 A1 Jun. 19, 2025

(30) Foreign Application Priority Data

Mar. 23, 2022 (JP) ..... 2022-046947

(51) Int. Cl.
*B65H 7/02* (2006.01)
*B65H 7/14* (2006.01)
(Continued)

(52) U.S. Cl.
CPC ..... *B65H 7/02* (2013.01); *B65H 7/14* (2013.01); *B65H 9/004* (2013.01); *B65H 9/166* (2013.01);
(Continued)

(58) Field of Classification Search
CPC . B65H 7/02; B65H 7/14; B65H 9/004; B65H 9/166; B65H 2404/144;
(Continued)

(56) References Cited

U.S. PATENT DOCUMENTS 5,253,862 A * 10/1993 Acquaviva ..... B65H 9/166 271/265.01
9,205,680 B2 12/2015 Mackey et al.
(Continued)

FOREIGN PATENT DOCUMENTS

JP H04-65231 U 6/1992
JP H07-33285 A 2/1995
(Continued)

OTHER PUBLICATIONS

Office Action issued in Japanese Application No. 2022-046947; Dated Apr. 9, 2024 (8 pages).
(Continued)

*Primary Examiner* — Prasad V Gokhale
(74) *Attorney, Agent, or Firm* — Osha Bergman Watanabe & Burton LLP

(57) ABSTRACT

A friction transport device includes a drive-side unit that transmits a transport driving force to one surface of a paper sheet transported along a transport path; a drive motor that supplies a driving force to the drive-side unit; a driven roller that is arranged to oppose the drive-side unit and that followingly rotates in contact with the other surface of the paper sheet; and a transport grip adjustment mechanism. The drive-side unit includes a drive roller that rotates on a shaft part orthogonal to a normal paper sheet transport direction, a rocking arm that includes the shaft part at one portion thereof and that has another portion thereof pivotally supported by a rocking shaft so as to change a transport grip by rocking the drive roller to change a distance from the driven
(Continued)

roller, and an elastic biasing member that elastically biases the drive roller toward the driven roller via the rocking arm. The transport grip adjustment mechanism is configured to cause the drive roller to retreat in a direction away from the driven roller against a biasing force from the elastic biasing member to decrease the transport grip when transport load applied to the drive roller from the paper sheet transported on the transport path by the drive roller forwardly rotating changes beyond a predetermined value.

7 Claims, 18 Drawing Sheets

(51) Int. Cl.
*B65H 9/00* (2006.01)
*B65H 9/16* (2006.01)

(52) U.S. Cl.
CPC ..... *B65H 2404/144* (2013.01); *B65H 2404/1521* (2013.01); *B65H 2553/41* (2013.01); *B65H 2701/1912* (2013.01)

(58) Field of Classification Search
CPC .... B65H 2404/1441; B65H 2404/1442; B65H 2404/1521; B65H 2404/72; B65H 2553/41; B65H 2701/1912
See application file for complete search history.

(56) References Cited

U.S. PATENT DOCUMENTS

| | | | | |
|---|---|---|---|---|
| 2006/0214363 | A1* | 9/2006 | Kawashima | B65H 9/06 271/226 |
| 2011/0062659 | A1* | 3/2011 | Richards | B65H 5/062 271/264 |
| 2017/0190531 | A1 | 7/2017 | Nakai | |
| 2020/0180886 | A1* | 6/2020 | Haraguchi | B65H 9/16 |
| 2021/0009371 | A1 | 1/2021 | Onishi et al. | |

FOREIGN PATENT DOCUMENTS

| | | | |
|---|---|---|---|
| JP | 2011255976 | A | 12/2011 |
| JP | 6405425 | B1 | 10/2018 |
| RU | 2631342 | C2 | 9/2017 |
| RU | 2746426 | C1 | 4/2021 |
| TW | 201910244 | A | 3/2019 |
| WO | 2011151984 | A1 | 12/2011 |
| WO | 2019186755 | A1 | 10/2019 |

OTHER PUBLICATIONS

Office Action issued in Taiwanese Application No. 112104800; Dated Oct. 18, 2023 (5 pages).
International Search Report issued in International Application No. PCT/JP2023/002306, mailed Apr. 4, 2023 (5 pages).
Written Opinion issued in International Application No. PCT/JP2023/002306; Dated Apr. 4, 2023 (4 pages).
Office Action issued in Russian Application No. 2024128196/11, mailed Feb. 5, 2025 (7 pages).
Extended European Search Report issued in counterpart European Patent Application No. 23774222.6, mailed on Feb. 1, 20, 2026 (8 pages).

* cited by examiner (a)

(b)

(a)

(b)

(c)

(d)

(e)

(f)

(a)

(b)

FRICTION TRANSPORT DEVICE AND PAPER SHEET TRANSPORT DEVICE

FIELD

The present invention relates to a technique of correcting or eliminating a transport failure related to the transport attitude, the transport direction, the transport position, or the like of a paper sheet in a paper sheet transport device that transports paper sheets such as banknotes.

BACKGROUND

In a variety of vending machines, a change machine, a cash dispenser, and other various types of money handling devices that receive an input banknote and provide goods or services for a user, a centering device or a skew correcting device that corrects a transport failure, such as misalignment from the central axis of a transport passage or skew of an input banknote, to normal position and attitude is incorporated.

A centering device and a skew correcting device correct the transport position or the transport attitude of a banknote on a transport passage to a state appropriate for determination by a recognition device located downstream. The centering device and the like prevent complication of various types of processing at subsequent stages due to a misaligned state of banknotes stacked in a banknote storing part that is located downstream from the recognition device, for example, complication of an aligning operation prior to setting of a batch of banknotes in a sorter or a counting device, and also prevents occurrence of jam when a batch of misaligned banknotes is set in a sorter or the like to be subjected to processing.

Besides, when a banknote inserted from an insertion port of a money handing device is transported while being abutting a sidewall of a transport passage due to skew or the like, the banknote receives a reaction force in a direction away from the sidewall and seeks to move in a direction aligned with the central axis of the transport passage. However, if a nipping force of transport rollers for the banknote is greater than the reaction force, there is a risk that a leading end corner portion or the like of the banknote causes a deformation such as fold or dent due to contact or rub with the sidewall, resulting in a transport failure or a recognition failure. In the worst case, the banknote is seriously damaged and is rendered unusable.

In a skew correction mechanism included in a paper sheet transport device disclosed in Patent Literature 1, a spherical body being brought to contact with a paper sheet rotates on its own axis depending on movement of the paper sheet. Accordingly, a frictional force (a transport grip) between the paper sheet and the spherical body is decreased and the reaction force generated on the paper sheet becomes larger than the frictional force with the spherical body. Therefore, the paper sheet moves in a direction cancel the reaction force, and the paper sheet is automatically aligned to be aligned with the central axis of the transport passage.

However, since the pressing force of the spherical body is low and the frictional force with a paper sheet is always low, jam is likely to occur also when a paper sheet that not skewed is brought to contact with a concavity or a convexity within the transport passage. Since the frictional force between the spherical body and a paper sheet is always constant, a sufficient transport grip cannot be provided in returning transport and a returning transport failure is disadvantageously likely to occur. Furthermore, foreign materials such as dust or dirt are likely to be attached on the spherical body surface with time, and the frictional force with a paper sheet is increased due to the attached foreign materials and prevents a desired aligning function from being provided.

Patent Literature 2 discloses a configuration to gradually align a banknote by causing the banknote to follow a reference wall in the course of obliquely transporting the banknote toward the reference wall by an inclined roller that rotates around an axis inclined by a predetermined angle with respect to the normal banknote transport direction.

However, since a configuration to reduce the transport grip between the inclined roller and a banknote is not included, a banknote is transported intensely pressed against the reference wall and is deformed or significantly damaged during adjustment of the direction or attitude of the banknote by cooperation of the inclined roller and the reference wall. That is, while being effective to alignment of a hard medium such as a credit card or a film, this configuration has a risk to cause a deformation of the medium or a deterioration of the condition at the time of contact with the reference wall and eventually cause jam during transport of a significantly creased medium, a tattered banknote, or a banknote not having "stiffness", for example, a limp, crumpled, or wet banknote.

Next, Patent Literature 3 discloses a friction transport device that includes a mechanism to change the transport grip between a drive roller and a paper sheet according to situations to advantageously perform skew correction while weakening the transport grip at a time of receiving a paper sheet, and advantageously perform returning transport or continuous insertion prevention while maintaining a state in which the transport grip is strong at a time of returning a paper sheet or at a standby time. In this friction transport device, the axial position of the drive roller is changed against an elastic biasing force when an external force in a direction other than the normal transport direction above a predetermined value is applied to a paper sheet, and a driven roller is configured to change the transport grip between the driver roller and the paper sheet according to the change in the axial position of the drive roller.

While this friction transport device has a high skew correcting function, there is a problem that the number of components is increased to complicate the configuration, and the durability of the drive roller is decreased due to wear. That is, the durability and the wear resistance of the drive roller are decreased due to friction at the time of moving of the drive roller in the axial direction with respect to the driven roller. For example, if the circumferential surface of the drive roller is worn by a thickness of about 1 millimeter (mm) due to wear, the transport grip significantly decreases.

CITATION LIST

Patent Literatures

Patent Literature 1: Japanese Patent Application Laid-open No. 2011-255976

Patent Literature 2: Japanese Patent Application Laid-open No. H7-33285

Patent Literature 3: Japanese Patent No. 6405425

SUMMARY

Technical Problem

The present invention has been made in view of the above circumstances, and has an object to provide a friction transport device and a paper sheet transport device that can correct paper sheets inserted from various positions or angles to a normal transport state while continuously transporting the paper sheets without any deformation of the paper sheets due to contact with a sidewall or the like.

The present invention also has an object to provide a friction transport device and a paper sheet transport device that advantageously perform skew correction while weakening the transport grip at a time of receiving a paper sheet, and advantageously perform returning transport or continuous insertion prevention while maintaining a state in which the transport grip is strong at a time of returning a paper sheet or a standby time.

Solution to Problem

In order to achieve the above object, a transport guide drive mechanism according to the present invention comprises: a drive-side unit that transmits a transport driving force to one surface of a paper sheet transported along a transport path; a drive motor that supplies a driving force to the drive-side unit; a driven roller that is arranged to oppose the drive-side unit and that followingly rotates in contact with the other surface of the paper sheet; and a transport grip adjustment mechanism, wherein the drive-side unit includes a drive roller that rotates on a shaft part orthogonal to a normal paper sheet transport direction, a rocking arm that includes the shaft part at one portion thereof and that has another portion thereof pivotally supported by a rocking shaft so as to change a transport grip by rocking the drive roller to change a distance from the driven roller, and an elastic biasing member that elastically biases the drive roller toward the driven roller via the rocking arm, and the transport grip adjustment mechanism is configured to cause the drive roller to retreat in a direction away from the driven roller against a biasing force from the elastic biasing member to decrease the transport grip when transport load applied to the drive roller from the paper sheet transported on the transport path by the drive roller forwardly rotating changes beyond a predetermined value.

Advantageous Effects of Invention

According to the present invention, paper sheets inserted from various positions or angles can be corrected to a normal transport state while preventing a deformation or a damage of the paper sheets due to contact with a sidewall or the like during continuous and unintermittent transport.

DESCRIPTION OF EMBODIMENTS

First Embodiment

Figure 1:
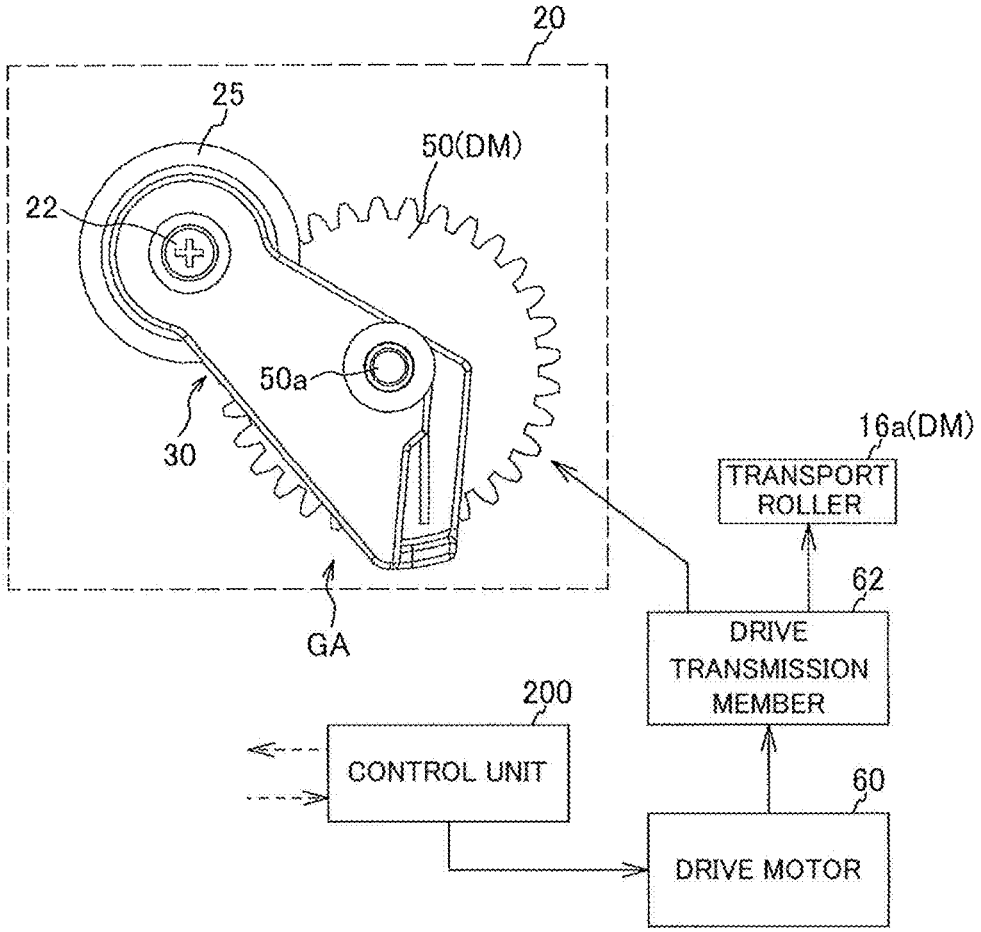
FIG. 1 is a side view illustrating a configuration of a transport grip adjustment mechanism included in a paper sheet transport device according to a first embodiment of the present invention.

The present invention will be described below in detail with embodiments illustrated in the drawings.

[Basic Configuration]

A basic configuration, an operating principle, and a skew correction principle of a banknote transport device including a friction transport device of the present invention are explained below.

Figure 2:
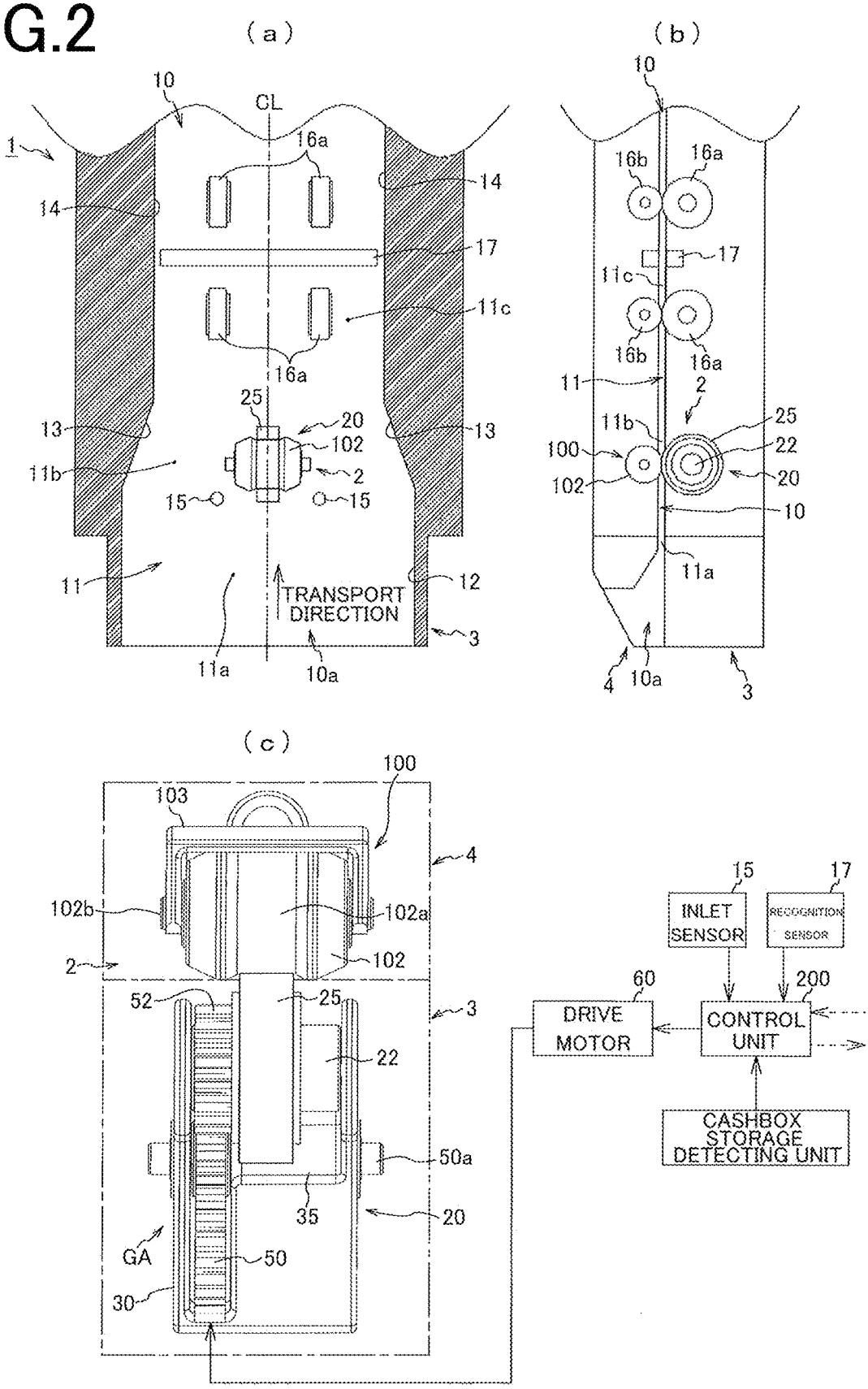
FIGS. 2(*a*), 2(*b*), and 2(*c*) are respectively a plan view illustrating a paper sheet transport path and a friction transport device in a simplified manner, a lateral vertical sectional view thereof, and a front view of relevant parts of the friction transport device.
Figure 3:
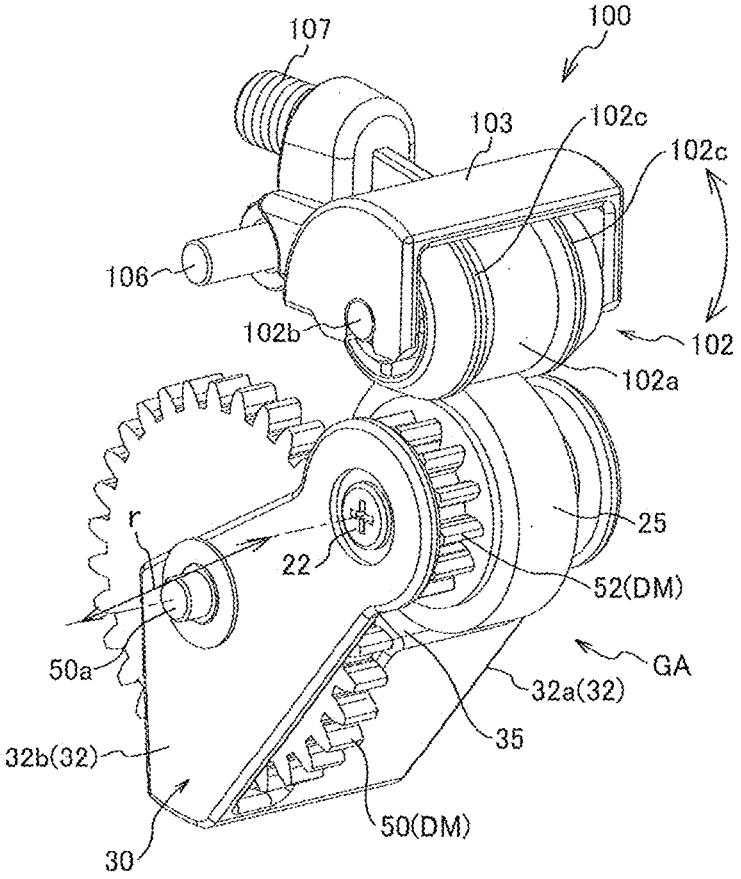
FIGS. 3(*a*) and 3(*b*) are perspective views of one example of the transport grip adjustment mechanism (a drive-side unit and a driven-side unit) constituting the friction transport device.
Figure 3:
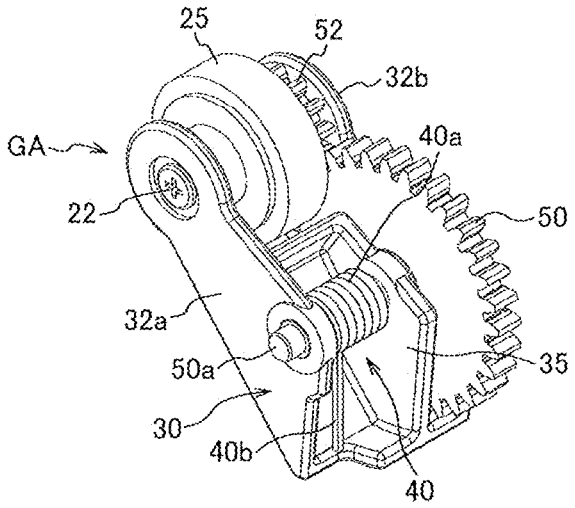
Figure 4:
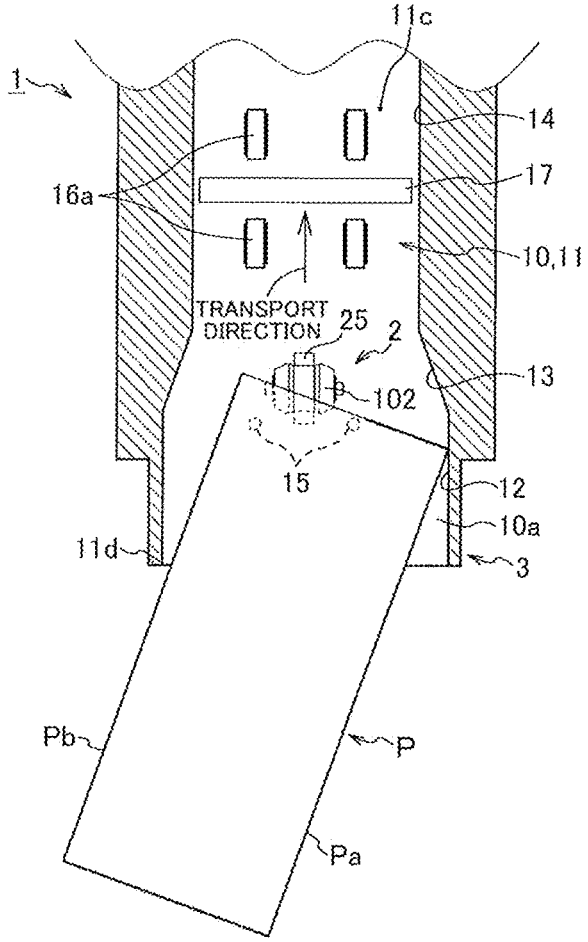
FIG. 4 is a plan view of the paper sheet transport path and the friction transport device for explaining a skew correction principle.
Figure 5:
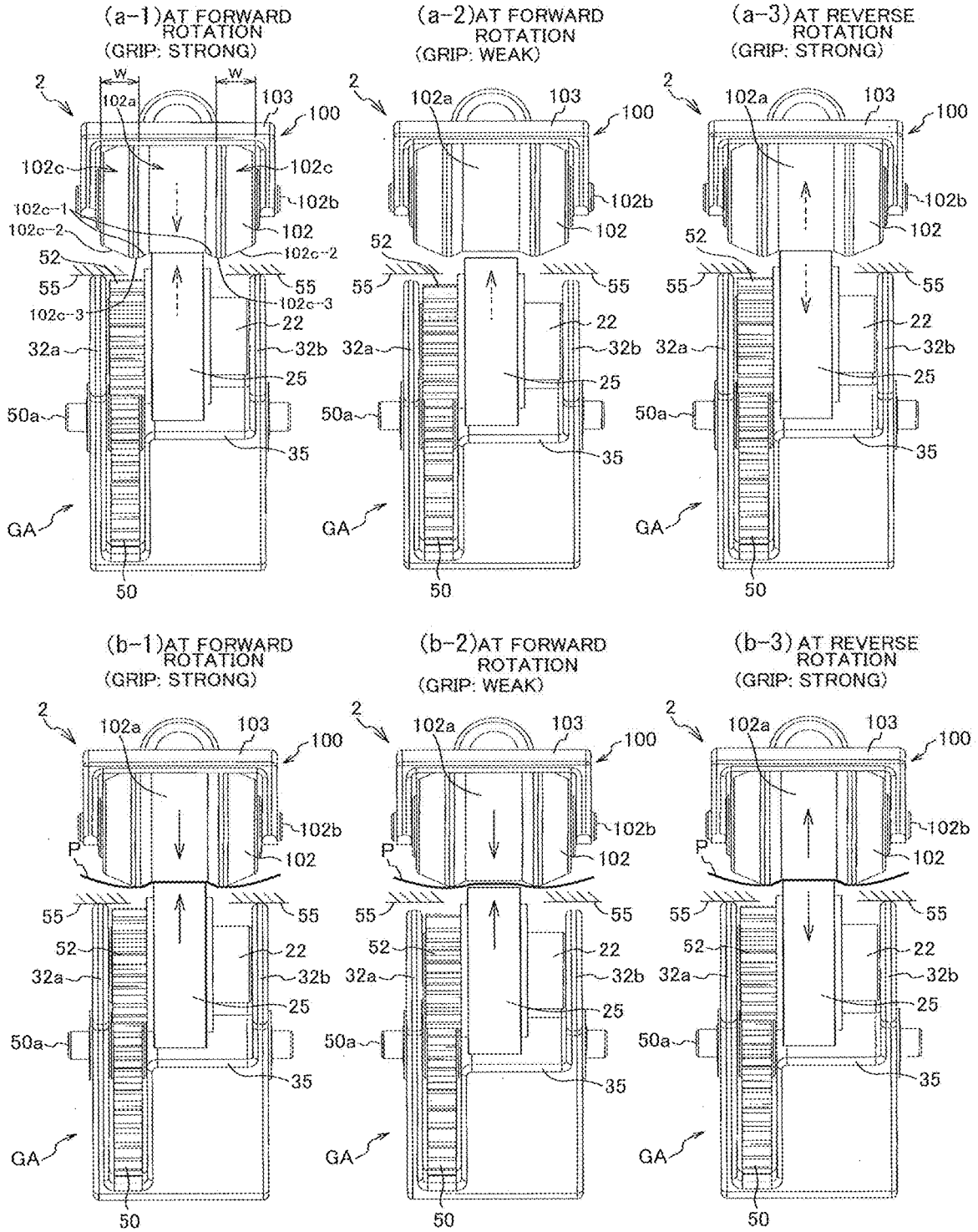
FIGS. 5(*a*) and 5(*b*) are front views of the drive-side unit and the driven-side unit, where FIGS. 5(*a*-1), 5(*a*-2), and 5(*a*-3) illustrate a most lifted state of the drive roller and a lowered state of the drive roller at the time of forward rotation in a state in which there is no banknote in a nip part, and a state at the time of reverse rotation, and FIGS. 5(*b*-1), 5(*b*-2), and 5(*b*-3) illustrate a most lifted state of the drive roller and a lowered state of the drive roller at the time of forward rotation in a state in which there is a banknote in the nip part, and a state at the time of reverse rotation.

FIG. 1 is a side view illustrating a configuration of a transport grip adjustment mechanism included in a paper sheet transport device according to a first embodiment of the present invention, FIGS. 2(*a*), 2(*b*), and 2(*c*) are respectively a plan view illustrating a paper sheet transport path and a friction transport device in a simplified manner, a lateral vertical sectional view thereof, and a front view of relevant parts of the friction transport device, FIGS. 3(*a*) and 3(*b*) are perspective views illustrating one example of the transport grip adjustment mechanism (a drive-side unit and a driven-side unit) constituting the friction transport device, FIG. 4 is a plan view of the paper sheet transport path and the friction transport device illustrating the skew correction principle, FIGS. 5(*a*) and 5(*b*) are front views of the drive-side unit and the driven-side unit, where FIGS. 5(*a*-1), 5(*a*-2), and 5(*a*-3) illustrate a most lifted state of the drive roller and a lowered state of the drive roller at the time of forward rotation in a state in which there is no banknote in a nip part, and a state at the time of reverse rotation, and FIGS. 5(*b*-1), 5(*b*-2), and 5(*b*-3) illustrate a most lifted state of the drive roller and a lowered state of the drive roller at the time of forward rotation in a state in which there is a banknote in the nip part, and a state at the time of reverse rotation.

FIGS. 6 to 9 are schematic diagrams illustrating how the drive roller and a transport grip adjustment mechanism GA behave upon reception of transport load from a transported medium such as a banknote as a relation of the behavior with moments of the components.

While banknotes are cited as one example of paper sheets in the present example, the present device is also applicable to skew correction in transport of paper sheets other than banknotes, for example, securities and tickets.

A banknote transport device 1 is used in a state attached to a banknote handling device body (not illustrated), and banknotes received by the banknote transport device 1 are subjected to recognition of banknote authenticity and denomination by a recognition sensor and are then sequentially stored one by one in a banknote stacking unit such as a cashbox in the banknote handling device body. When a banknote to be transported in the banknote transport device 1 is displaced in the transport position or skewed, a recognition failure or jam occurs, or the alignment of banknotes stored in a stacked state in the cashbox is deteriorated, which causes decrease of the workability in subsequent handling of the banknotes. For this reason, the transport position and the transport attitude of a banknote introduced into the banknote transport device 1 and transported therein are required to be constant or within an acceptable range.

As illustrated in FIGS. 2, the banknote transport device 1 includes a lower unit 3, and an upper unit 4 supported by a shaft part to be capable of opening and closing with respect to the lower unit 3, and a banknote transport path 10 is formed between these units when the units are closed.

The banknote transport device 1 includes a friction transport device 2 for automatically correcting a transport failure when a banknote P transported on the banknote transport path 10 (a banknote transport surface 11) includes a transport failure such as positional misalignment or skew.

The friction transport device 2 generally includes a drive-side unit 20 that transmits a transport driving force to one surface (a lower surface) of a banknote P transported with the surface in contact with an upper surface (the banknote transport surface 11) of the banknote transport path (transport path) 10, a drive source (a drive motor) 60 that supplies a driving force to the drive-side unit, a driven roller 102 (a driven-side unit 100) that is arranged to oppose the drive-side unit and that followingly rotates being in contact with the other surface of the banknote, the transport grip adjustment mechanism GA that can change a transport grip between a drive roller, which will be described later, and a banknote, and a control unit 200 that controls various control targets.

While the drive-side unit 20 is arranged on the lower unit 3 and the driven-side unit 100 is arranged on the upper unit 4 in the present example, the arrangement locations of these units may be inverted.

As illustrated in FIG. 2 and other drawings, the banknote transport surface 11 that guides the lower surface of a banknote P with the upper surface, sidewalls 12, 13, and 14 continuously arranged in an erect state on each of both sides of the banknote transport surface 11 in the width direction, an inlet sensor (banknote detection sensor) 15 that is constituted of an optical sensor or the like detecting entry of an inserted banknote, lower transport rollers 16*a* that are each arranged with a circumferential surface exposed from an opening provided on the banknote transport surface 11 (a back transport surface 11*c*) downstream from the friction transport device 2, upper transport rollers 16*b* that are arranged on the side of the upper unit 4 to oppose the transport rollers 16*a*, and a recognition sensor 17 constituted of an optical sensor or the like are arranged on the banknote transport path 10.

The inlet sensor 15 detects insertion of a banknote from an inlet of the banknote transport path 10 and the control unit 200 drives the drive motor 60 at the detection timing to cause the drive-side unit 20 to start forwardly rotating. A first banknote is transported on the banknote transport path 10 toward the inner back part by the driving of the drive-side unit 20. When the rear end portion of the banknote passes the recognition sensor 17, the drive-side unit 20 is stopped. Accordingly, even when a second banknote is inserted into a nip part between the drive roller and the driven roller, the banknote is not transported. Also after the stop of the drive-side unit, the first banknote is transported toward the cashbox by driving of the transport rollers 16*a* and 16*b* downstream from the recognition sensor. When storage into the cashbox is detected by a cashbox storage detecting unit, the control unit 200 temporarily stops the drive motor 60. At the time of detecting completion of the storage of the first banknote into the cashbox, the control unit 200 causes the device to proceed to a state in which second and subsequent banknotes can be transported. That is, with detection of insertion of a second banknote into the inlet of the banknote transport path by the inlet sensor 15, the control unit 200 resumes driving of the drive-side unit 20.

As illustrated in FIG. 1, a drive transmission mechanism DM that transmits the driving force from the drive motor 60 to a drive roller 25 constituting the transport grip adjustment mechanism GA includes the drive-side unit 20, the transport rollers 16, and other members. Drive transmission members 62 such as a gear, a belt, and a pully are placed between the drive motor 60 and the drive roller 25, and transmit the driving force from the drive motor to the drive roller 25 and the transport rollers 16*a* and 16*b*.

A discharge port communicated with a cashbox (not illustrated) is positioned at a rear end portion of the banknote transport path 10.

As illustrated in FIG. 2(*a*), the banknote transport surface 11 has an inlet-side transport surface 11*a* close to an inlet 10*a* being a banknote insertion port and having the greatest width, an intermediate transport surface 11*b* that has a width gradually decreasing in a tapered manner toward the back, and the back transport surface 11*c* located in the most back portion and having the smallest width.

The sidewalls erected on both lateral sides of each of the transport surfaces include inlet-side sidewalls 12 arranged on both sides of the inlet-side transport surface 11*a*, intermediate sidewalls 13 that are arranged on both side of the intermediate transport surface 11*b* and that are spaced with a distance gradually decreasing in a tapered manner, and back sidewalls 14 that are arranged on both sides of the back transport surface 11*c*.

In the configuration of the present example, the inlet-side transport surface 11*a* that receives a banknote is wide (86 mm), the width of the back transport surface 11*c* is the smallest (for example, 68 mm), and the intermediate transport surface 11*b* has a width gradually decreasing in a tapered manner. This is an arrangement to facilitate insertion of a banknote along a gently inclined surface and enables a banknote to be transported with an corner portion of the leading end of the banknote along the wall surface of the inclined intermediate sidewalls 13 being in contact therewith to be centered on the transport path.

Since the inlet width of the transport path is greater than the banknote width, a banknote is inserted at various positions or various inclination angles. However, according to the friction transport device 2, a banknote that is transported with an corner portion of the leading end or other parts being in contact with the sidewall due to insertion at various positions or various inclination angles can be shifted toward the center of the transport path or one of the sidewalls while the transport attitude is corrected to be in parallel to the normal transport direction.

The configuration of the banknote transport surface 11 and the sidewalls illustrated in the drawings is merely an example, and the transport path may have a wide and same dimension throughout its length, or may have a narrow and same dimension throughout its length. Alternatively, the friction transport device 2 is also applicable to a type including a variable guide that can vary the width of the transport path at the inlet.

The friction transport device 2 in the present example is arranged within the range of the intermediate transport surface 11*b*. This configuration is to prevent or eliminate a banknote P introduced from the inlet 10*a* from being deformed or causing skew due to being brought to contact with one of the tapered intermediate sidewalls 13 to be subject to a reaction force and to be intensely pressurized at a leading end corner portion by the intermediate sidewall. Therefore, also when arranged on any other transport surfaces 11*a* and 11*c* of the banknote transport surface 11, the friction transport device 2 can provide a function to prevent or eliminate a deformation or skew of a banknote resulting from a reaction force generated due to contact between the sidewall 12 or 14 and a banknote, or other causes.

The friction transport device 2 is means for correcting the introduction attitude or the transport attitude of a banknote P to be aligned with a central axis CL of the transport path 10 or with a sidewall in a course in which the banknote P that is brought to contact with a sidewall or the like of the transport path to receive a reaction force in a direction different from the normal transport direction due to being inserted by a user from the inlet 10*a* of the banknote transport path 10 from various positions, at various angles, or in various directions and with various irregular attitudes is continuously and unintermittently introduced and transported toward the back portion of the transport path. The drive-side unit 20 illustrated in FIG. 1 includes one drive roller 25 (rocking roller) that is supported to be rotatable on a shaft part 22 extending in a direction orthogonal to (intersecting with) the normal banknote transport direction indicated by an arrow in FIG. 2(*a*) (that is rotatably supported at a shaft center by the shaft part), a rocking arm 30 that pivotally supports, with one portion thereof (an upper appropriate position), the shaft part 22 supporting the drive roller and that has the other portion (a lower appropriate position) thereof pivotally supported by a rocking shaft 50*a* so as to change the transport grip by rocking the drive roller to change the distance from the driven roller 102, an elastic biasing member 40 (FIG. 3(*b*)) that elastically biases the drive roller toward the driven roller 102 via the rocking arm, and the drive transmission mechanism DM including the drive transmission members 62 that transmit the driving force from the drive motor 60 to the drive roller.

The drive roller 25 has a portion of the circumferential surface protruded from an opening provided on the banknote transport surface 11, and other constituent elements such as the transport grip adjustment mechanism GA are arranged below the banknote transport surface.

The transport grip adjustment mechanism GA is configured to separate the drive roller from the driven roller (the banknote transport surface 11) to decrease the transport grip against the elastic biasing force of the elastic biasing member 40 when an external force (a reaction force from a sidewall, or the like) above a predetermined value in a direction other than the normal transport direction is applied to a banknote transported on the transport path 10 by forward rotation of the drive motor 60 (when transport load applied from the banknote to the drive roller changes beyond a predetermined value). The drive roller changes the distance from the driven roller by rocking of the rocking arm 30 on the rocking shaft 50*a* with the distance of a radius r kept therefrom.

The driving force from the drive motor 60 is transmitted to an input gear 50 via the drive transmission members 62, and the input gear 50 meshes with an output gear 52 coaxially integrated with the drive roller, to rotate the drive roller. The rocking arm 30 includes a configuration capable of rocking on the rocking shaft 50*a* being the rotation axis of the input gear 50 in the upper and lower directions (the forward rotation direction and the reverse rotation direction). The rocking arm 30 and the input gear 50 are in a relation relatively rotating.

When the transport load applied from a banknote to the drive roller is not above the predetermined value during transport of the banknote in the receiving direction, the circumferential speeds of the input gear 50 and the output gear 52 are kept equal. Therefore, the rocking arm maintains a state (an initial state, an initial position) pressed by the elastic biasing member 40 against a stopper member 55 and does not rock. Meanwhile, when the transport load from a banknote applied to the drive roller 25 exceeds the predetermined value, the circumferential speed of the output gear becomes lower than that of the input gear, and the rocking arm accordingly rocks by the difference in the circumferential speed (the rocking arm moves away from the initial position). This feature is explained in detail with reference to FIGS. 6, 7, and 8.

The drive transmission members 62 that transmit the driving force from the drive motor 60, the input gear 50 that rotates upon reception of the driving force transmitted from the drive transmission members, and the output gear 52 that is coaxially integrated with the drive roller 25 and that meshes with the input gear to receive transmission of the driving force constitute the drive transmission mechanism DM.

The drive motor 60 is controlled by the control unit 200.

The rocking arm 30, the elastic biasing member 40, the drive transmission mechanism DM, and the stopper member 55 (see FIG. 6 and the like) as means for defining an upper limit position (a forward rotation limit position) of the rocking arm constitute the transport grip adjustment mechanism GA.

The transport grip adjustment mechanism GA is configured to change the frictional force (hereinafter, "transport grip") between the drive roller 25 and a banknote P according to the value of load from the banknote passing through between the drive roller and the driven roller, and the direction of the load (the transport status).

That is, the transport path 10 includes the sidewalls 12 and 13, and the transport grip adjustment mechanism GA operates to decrease the transport grip by moving the drive roller 25 in a direction away from the drive roller 102 when a banknote is brought to contact with a sidewall and is subject to an external force exceeding the predetermined value in a direction other than the normal banknote transport direction in the course of transport of the banknote in the receiving direction along the transport path.

The value of the decreased transport grip is a value that enables a change to a direction to cancel the external force from the sidewall in cooperation with the sidewall by eliminating or reducing constraint on the banknote by the nip part between the rollers 25 and 102. That is, the value of the decreased transport grip is a value that can correct a banknote in a transport failure state to have a transport attitude parallel to the normal banknote transport direction, or that enables sideslip (including rotation and slide in other various directions) of the banknote between the drive roller and the driven roller so as to be moved in the width direction with respect to the normal transport position.

The friction transport device 2 introduces a banknote with an appropriate transport grip without actuating the transport grip adjustment mechanism GA when receiving a banknote inserted with a normal attitude at a normal angle. On the other hand, when a banknote is subject to a reaction force from a sidewall due to an abnormal insertion angle, insertion attitude, or insertion position, the friction transport device 2 actuates the transport grip adjustment mechanism to weaken the transport grip (for example, 25 gf) and automatically and efficiently performs skew correction. At the time of returning a banknote or a standby time for preventing continuous insertion, the transport grip adjustment mechanism GA maintains a state of a strong transport grip (for example, 70 gf) to efficiently realize returning transport or prevention of continuous insertion.

The elastic biasing force of the elastic biasing member 40 is set, for example, to enable fine adjustment of the vertical position (the distance from the driven roller) of the drive roller, that is, the rocking angle of the rocking arm 30 in response to a fine change of the transport load applied from a banknote to the drive roller.

Specifically, the value of the transport grip at a time when the drive roller 25 is at the initial position because the transport grip adjustment mechanism GA is not actuated is maintained at such a value that enables a banknote nipped with the driven roller to be reliably transported straight. On the other hand, when the transport grip adjustment mechanism is actuated and the drive roller is moved in a direction away from the driven roller, the transport grip is set to be weaker than that at the time when the drive roller is at the initial position and to enable a banknote to be easily changed in the direction by a reaction force applied from a sidewall. That is, the transport grip at the time when the drive roller is at the initial position is previously set by the elastic biasing member 40 to a predetermined value to enable the transport grip to be decreased to such a level of weakness that skew correction can be performed with a high responsiveness immediately when the drive roller having received the load from a banknote starts moving (displacing) downward.

With provision of one pair of the drive-side unit 20 and the driven-side unit 100 as in the present embodiment, a mechanism that automatically corrects skew of a banknote can be sufficiently constructed. However, two or more pairs may be arranged as required along the width direction of the transport path.

The external force, which is applied to a banknote P to be transported, above the predetermined value in a direction other than the normal transport direction includes a reaction force applied from a sidewall to the banknote, transport load associated with a deformed portion formed on the banknote itself, transport load from resistance of a component or a protrusion located on the transport path, and the like.

The drive roller 25 is forwardly and reversely rotatably supported at the shaft center by the shaft part 22 arranged to penetrate through an upper end portion of the rocking arm 30, and the output gear 52 is coaxially integrated with the drive roller, so that the output gear and the drive roller integrally rotate. The drive roller and the output gear 52 may be integrated with the shaft part 22 rotatably supported on the rocking arm, or the drive roller and the output gear may be rotatably supported on the shaft part 22 that does not rotate.

The drive roller 25 in the configuration example illustrated in the drawings is a cylindrical body with a flat outer circumferential surface, and the driven roller 102 has a so-called tsuzumi (Japanese hand drum) shape where an axially central portion 102*a* opposing the outer circumferential surface of the drive roller is dented. In other words, since the driven roller 102 has a protrusion (an annular ridge) 102*c* having a predetermined axial width W on each of both end edges in the axial direction, the axially central portion 102*a* of the driven roller 102 is a recessed part (an annular groove) Since being a cylindrical surface including no raised or constricted portion, the outer circumferential surface of the axially central portion (the recessed part) 102*a* is in close contact with the outer circumferential surface of the cylindrical drive roller 25 when the grip is strong as in FIGS. 5(*a*-1) and 5(*b*-2). Each of the protrusions 102*c* has a mountain shape including an inner inclined surface 102-*c* and an outer inclined surface 102*c*-2. A top portion 102*c*-3 having a substantially flat outer circumferential surface is provided between the inner inclined surface 102*c*-1 and the outer inclined surface 102*c*-2.

Figure 6:
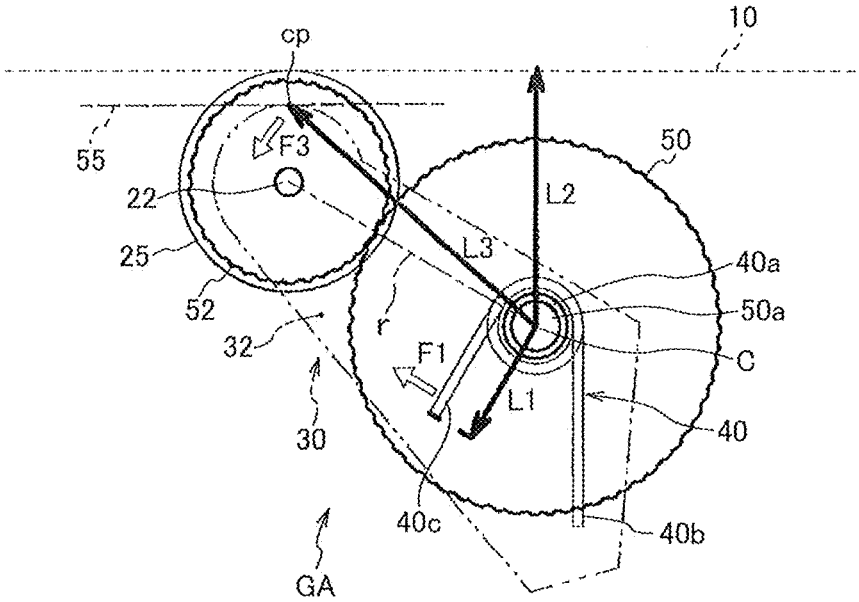
FIGS. 6(*a*) and 6(*b*) are schematic diagrams illustrating how the drive roller and a transport grip adjustment mechanism GA behave upon reception of transport load from a banknote as a relation of the behavior with moments of components.
Figure 6:
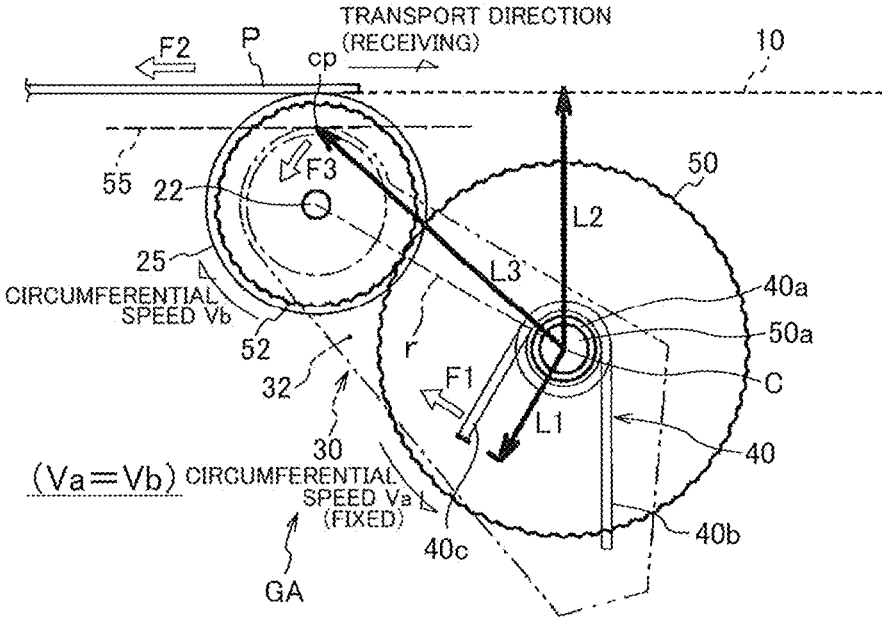

Accordingly, when the drive roller is at the initial position as in FIG. 6(*b*), the circumferential surface of the drive roller is fit in the axially central portion (the recessed part) 102*a* of the driven roller to be in contact with the outer circumferential surface of the recessed part. A banknote P is intensely pressurized only at an axially central portion positioned between the circumferential surface of the drive roller and the axially central portion 102*a* and regions of the banknote corresponding to the protrusions 102*c* are not intensely pressurized, so that the banknote is deformed in an inverted U shape (an inversely concave shape) as a whole (a grip transport state). Meanwhile, when the transport grip adjustment mechanism GA is actuated as in FIG. 7(*c*), the drive roller is at a retreated position (an actuated position), so that a banknote P positioned between the circumferential surface of the drive roller and the recessed part 102*a* is not intensely pressurized and is in a substantially flat state (a gap-type transport state).

In the illustrated embodiment, the protrusions 102*c* (the inner inclined surfaces 102*c*-1) are formed directly next to the both sides of the axially central portion 102*a* having the same axial width of the drive roller 25 and to be continuous thereto. That is, there is no space between each of the both end parts of the axially central portion 102*a* and the corresponding protrusion 102*c*. However, this is an example and no problem occurs even when a short cylindrical portion (a portion not in contact with the drive roller) having the same diameter as that of the axially central portion 102*a* is located between the axially central portion 102*a* and each of the protrusions 102*c*.

The rocking arm 30 is pivotally supported at the other portion to cause the drive roller to rock about the rotation axis of the input gear 50 parallel to the shaft part 22, that is, the rocking shaft 50*a*. The rocking arm is pivotally supported by the rocking shaft 50*a* of the input gear to be capable of relatively rotating with respect to the input gear. The drive roller rocks with the length of a line connecting the rocking shaft 50*a* and the shaft part 22 as a radius r.

As illustrated in FIG. 3 and other drawings, the rocking arm 30 includes an arm member 32 that supports the shaft part 22, the drive roller 25, and the output gear 52, and a gear supporting member 35 that is continuously provided and integrated with the arm member 32 to support the elastic biasing member 40 and the rocking shaft 50*a* of the input gear 50.

The arm member 32 is composed of two arm members 32*a* and 32*b* arranged to oppose with a predetermined distance away from each other, and the gear supporting member 35 is integrated to base end portions of the two arm members 32*a* and 32*b*. The rocking shaft 50*a* of the input gear is supported as a shaft across the base end portion of the arm member 32*a* and the gear supporting member 35, and the input gear 50 is rotatably supported on the rocking shaft. A central portion 40*a* of the elastic biasing member 40 is placed on the rocking shaft 50*a* exposed between the base end portion of the arm member 32*a* and the gear supporting member 35 to pass the rocking shaft therethrough and is supported thereby.

The elastic biasing member 40 is means for biasing the rocking arm 30 in the clockwise direction (the pressurizing direction) to cause the drive roller 25 to be biased toward the driven roller 102. In the present embodiment, as illustrated in FIG. 3(*b*) and other drawings, the elastic biasing member 40 is a kick spring (a torsion spring), and the coiled central portion 40*a* is loosely fitted on the rocking shaft 50*a* of the input gear, one arm 40*b* is fixed at an appropriate position of the gear supporting member 35, and the other arm 40*c* is fixed (engaged) at an appropriate position of the base end portion of the rocking arm, so that the elastic biasing member 40 biases the rocking arm in the clockwise direction, that is, in a direction to lift the drive roller using an expanding force of the other arm 40*c*. That is, the arm member 32 is biased in the clockwise direction in FIG. 3(*b*) (the counterclockwise direction in FIG. 3(*a*)) due to load of the elastic biasing member, whereby the circumferential surface of the drive roller is pressurized to cause the circumferential surface to approach the circumferential surface of the driven roller while opposing therewith. The direction of biasing of the drive roller by the elastic biasing member 40, that is, the moving direction of the drive roller is considerably different from the biasing direction or the moving direction of the drive roller in Patent Literature 3 in that this is a direction non-parallel to the axis direction of the shaft part 22, that is, a direction intersecting with (orthogonal to) the axis direction of the shaft part 22.

When the transport grip adjustment mechanism GA is not actuated, the drive roller 25 is at the most lifted initial position and maintains the transport grip on a banknote passing the nip part with the driven roller 102 at an appropriate intensity. Meanwhile, when the transport grip adjustment mechanism GA is actuated and the drive roller is accordingly displaced to an actuated position retreated (separated) from the driven roller 102, the transport grip is decreased to enable a banknote to sideslip on the drive roller. Since the drive roller is finely displaced between a position closest to the driven roller and a most separated position (including point contact and line contact), the elastic biasing force of the elastic biasing member 40 is set to cause also the transport grip to finely change according to a minute change in the vertical position of the drive roller. The elastic biasing force of the elastic biasing member is set to enable the drive roller to move to retreat downward immediately with a high responsiveness when load is applied from a banknote to the drive roller in a state in which the drive roller is closest to the driven roller.

As illustrated in FIGS. 3(*a*), 12, 13 and other drawings, the driven roller 102 is supported at a shaft part 102*b* by a holding member 103 to be capable of forwardly and reversely rotating. The holding member 103 is supported by a shaft 106 located backward to be capable of rocking in the upper and lower directions, thereby enabling the driven roller 102 to be retreated upward from a lower limit position close to the banknote transport surface 11 (the drive roller). The holding member 103 cannot protrude downward beyond the predetermined lower limit position due to a stopper structure (not illustrated) while being biased by an elastic member 107 (a coil spring) toward the lower limit position. The biasing force of the elastic member 107 is set to be sufficiently greater than the load of the elastic biasing member 40 provided on the drive-side unit 20, and the driven roller is hardly raised from the lower limit position by load as great as the transport load from a banknote passing through the nip part. Only when the driven roller is pushed upward by a predetermined or greater force, such as in a case in which a hard foreign material such as a plastic card is forcibly inserted into the nip part between the drive roller and the driven roller, the driven roller is raised (retreated) against the elastic member to be prevented from being subject to a damage such as breakage.

The driven roller 102, the holding member 103, the shaft 106, the stopper structure, and the elastic member 107 constitute the driven-side unit 100.

In the present embodiment, an example in which one set of the drive-side unit 20 and the driven-side unit 100 is arranged on one transport path 10 is described. However, plural sets may be arranged along the width direction. The drive roller has a high flexibility in the diameter, the thickness in the width direction, and the like and can be adjusted or set to have appropriate states thereof according to a use condition of a target device.

FIGS. 6 to 9 are schematic diagrams illustrating how the drive roller and the transport grip adjustment mechanism GA behave upon reception of transport load from a banknote as a relation of the behavior with moments of the components.

The arm member 32 constituting the rocking arm 30 is brought to contact with the stopper member 55 (a positioning unit) provided on the side of the device body at the time of lifting, thereby being prevented from further lifting. Accordingly, the most lifted position of the driver roller 25 supported on the arm member 32 via the shaft is also defined by the stopper member 55. That is, the stopper member 55 is means for defining the upper limit positions (forward rocking limit positions) of the rocking arm and the drive roller.

Even when a banknote transported in the receiving direction is not subject to a reaction force from the sidewalls or the like, some transport load is always generated because the banknote advances on the banknote transport path. However, the transport load at this time is sufficiently small and the load in the clockwise direction (a forwardly rocking direction) applied from the elastic biasing member 40 to the rocking arm 30 is greater than the transport load. Accordingly, the rocking arm does not lower, and the drive roller forwardly rotates while maintaining the initial position, and causes the banknote to move straight in the normal transport direction while maintaining a sufficient transport grip.

On the other hand, when the transport load exceeds a predetermined value (a force with which the elastic biasing member holds the rocking arm at the initial position) because an inserted banknote is brought to contact with a sidewall due to skew, the rocking arm rotationally moves the drive roller in a direction away from the driven roller (reversely rocking direction=retreat direction). Accordingly, the transport grip is decreased and a banknote can perform a free behavior, such as sideslip or rotation, in the nip part between the drive roller and the driven roller. When the drive roller continues the forward rotation in this state, the banknote is modified in the direction, attitude, and transport position to the normal state by a reaction force caused by the contact with the sidewall.

This example is explained assuming the length of one arm 40*c* of the elastic biasing member (the length of a line extending in parallel to the arm 40*c* from a central point C of the rocking shaft 50*a*) is L1, load in the upward direction (the clockwise direction) applied from the arm 40*c* to the arm member 32 is F1, the minimum distance from the central point C to the transport path 10 is L2, transport load on a banknote is F2, the distance from the central point C to a region cp of the arm member 32 being in contact with the stopper member 55 is L3, and load applied downward from the stopper member 55 to the arm member 32 (a reaction force from the stopper member) is F3.

The transport direction at the time of receiving a banknote is the rightward direction.

A relation for balancing a moment F1×L1 (a moment acting from the elastic biasing member on the rocking arm), a moment F2×L2 (a moment related to the transport load), a moment F3×L3 (a moment acting on the contact point cp between the rocking arm and the stopper member) is expressed by a basic formula: F1×L1=F2×L2+F3×L3.

FIG. 6(*a*) illustrates a state (a standby state) in which the input gear 50, the output gear 52, and the drive roller 25 are stopped rotating because the drive motor 60 is stopped, and there is no banknote between the drive roller and the driven roller. In this case, the transport load F2=0. When this value is plugged into the basic formula, F1×L1=F3×L3 and the balanced state is maintained.

At this time, an upper end portion of the arm member 32 is in contact with the lower surface of the stopper member 55 and the arm member 32 cannot rock upward any more. The drive roller 25 is in a state in which a portion is protruded on the banknote transport surface 11.

When a banknote is inserted from the inlet of the banknote transport path 10 in this standby state, the inlet sensor 15 located immediately before the drive roller detects the banknote. The control unit 200 drive the drive motor 60 based on this detection signal to transport the banknote with the transport rollers 16*a* and 16*b* through the discharge port to the cashbox. When the cashbox storage detecting unit detects storage of the banknote into the cashbox, the control unit stops the drive transmission mechanism DM.

The drive transmission mechanism DM does not enter a drivable state until completion of processing is confirmed due to storage of a preceding banknote into the cashbox. Accordingly, the drive transmission mechanism DM is not driven even when a user attempts to insert a following banknote through the inlet during processing of the preceding banknote. Even when a banknote is forced to be inserted into the nip part between the drive roller and the driven roller that are in the stopped state at this time, the insertion is impossible because the drive roller is pressed against the upper limit position by the force of the elastic biasing member 40 and the transport grip is not reduced (a state in FIG. 13 which will be described later).

As described above, in the friction transport device 2 of the present embodiment, insertion of a following banknote is impossible during stop of the drive transmission mechanism DM and jam and other troubles can be prevented.

Next, FIG. 6(*b*) illustrates a state in which the drive roller 25 is rotationally driven in the forward rotation direction upon reception of the driving force from the drive motor 60, and a normal banknote is introduced with the normal attitude that is not in contact with the sidewalls, concave or convex portions, and the like and is transported in the normal direction (the transport grip adjustment mechanism GA is unactuated). The transport load F2 at this time is small enough not to greatly affect the reaction force F3 applied from the stopper member 55 to the arm member 32. Therefore, the state of F1×L1=F2/L2+F3×L3 is maintained. As described above, even during passing of a banknote through the nip part, the arm member does not rock downward (reversely rock) when F1×L1≥F2×L2. In other words, even if the rocking arm 30 lowers during passing of a banknote through the nip part, the lowering amount is so small that the change amount of the transport load F2 is negligible. When the transport load F2 is increased to produce a state of F1×L1<F2×L2, the arm member starts rotationally moving in the counterclockwise direction (downward=reverse rotation direction) on the rocking shaft 50*a*.

In the illustrated state, a circumferential speed Va of the input gear 50 is constant and is substantially the same as a circumferential speed Vb of the drive roller 25 (the output gear 52). As long as the circumferential speed Va and the circumferential speed Vb are substantially the same, the position of the drive roller 25 (the output gear) with respect to the input gear 50 does not change and the positional relation between the drive roller and the driven roller 102 does not change. That is, as long as the arm member maintains the illustrated initial position, the circumferential speed Va of the input gear 50 and the circumferential speed Vb of the output gear 52 are constant and substantially the same.

In this state, the transport grip provided by the drive roller has a value appropriate for stable transport of a banknote, that is, such a value as to enable a banknote to be stably sent in the straight advancing direction when the drive roller forwardly rotates.

Figure 7:
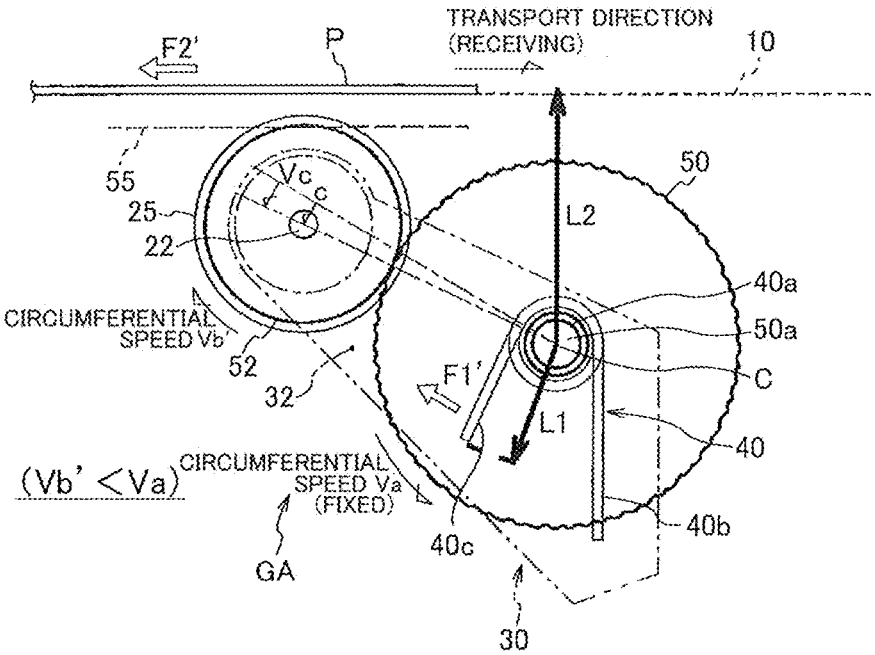
FIGS. 7(*c*) and 7(*d*) are schematic diagrams illustrating how the drive roller and the transport grip adjustment mechanism GA behave upon reception of transport load from a banknote as a relation of the behavior with moments of components.
Figure 7:
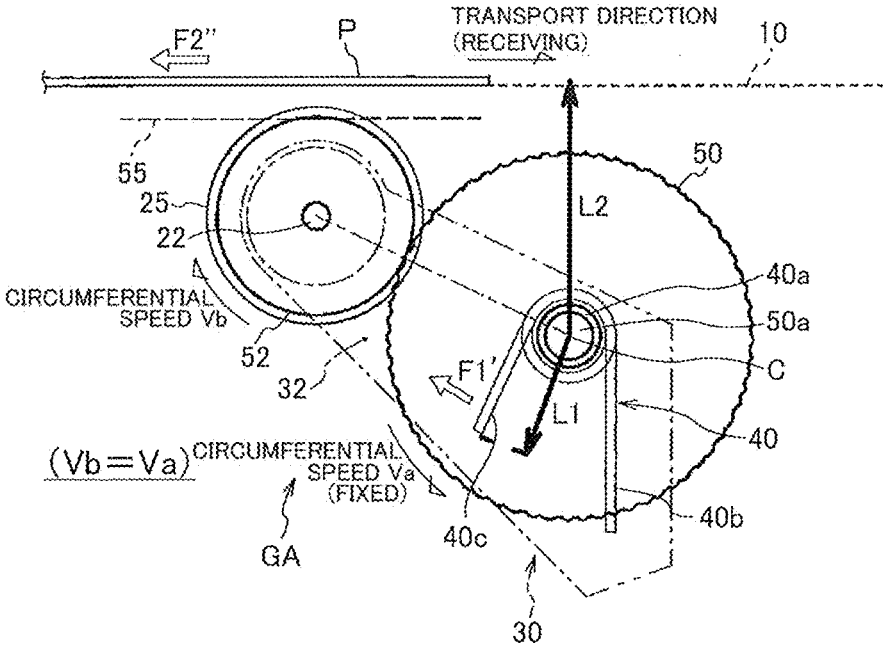

FIG. 7(*c*) illustrates a state after a time point when the transport load F2 increases to be F2' (the transport grip adjustment mechanism GA is actuated). That is, when the transport load F2 increases beyond the predetermined value to become F2' due to a cause such as contact of a banknote with a sidewall, the rocking arm 30 (the drive roller) starts rocking downward (reversely rotating) as indicated by an arrow c.

This behavior is explained as follows.

First, when the moment (F1×L1) acting from the elastic biasing member on the rocking arm≥the moment (F2×L2) related to the transport load, the transport grip adjustment mechanism GA is not actuated in a direction to lower the drive roller (at this time, F1*L1=F2×L2+F3×L3).

Next, when F1×L1<F2'×L2 because the transport load increases beyond the predetermined value to become F2', the transport grip adjustment mechanism GA starts being actuated in the direction to lower the drive roller (FIG. 7(*c*)).

Further, when the state shifts from that in FIG. 7(*c*) to that in FIG. 7(*d*) because the transport load F2' decreases to be F2", and a relation F1'×L1=F2"×L2 is met, the operation to lower the drive roller by the transport grip adjustment mechanism GA stops.

The operating principle of the transport grip adjustment mechanism GA is as follows when explained as a relation with the circumferential speeds of the drive roller 25 and the input gear 50.

The drive roller 25 forwardly rotates at the circumferential speed Vb during normal transport as illustrated in FIG. 6(*b*). When a reaction force acts on a banknote as in FIG. 7(*c*) and a state (F2') in which the transport load F2 is above the predetermined value is produced, the circumferential speed Vb of the drive roller (the input gear 50) decreases to become Vb', and a rotation speed difference from the circumferential speed Va (constant) of the input gear 50 is generated. Since the circumferential speed Vb' of the drive roller is lower than the circumferential speed Va of the input gear 50, the rocking arm 30 rocks in the counterclockwise direction to follow the input gear 50 rotating at a higher speed. Accordingly, the drive roller starts moving downward. Assuming the speed at which the drive roller lowers is Vc, the circumferential speed Vb' of the drive roller has a relation of Vb'=Va−Vc. The drive roller moves in a direction away from the driven roller by the difference in the circumferential speed between the input gear and the drive roller. Therefore, a space is generated between the rollers 25 and 100 and the transport load F2 is decreased.

When the transport load F2 is decreased by the actuation of the transport grip adjustment mechanism GA, the rocking arm and the drive roller rock downward to a position where the decreased transport load F2" is balanced against the load F1' from the elastic biasing member 40, and stop at that position as illustrated in FIG. 7(*d*).

In other words, the load F1' from the elastic biasing member in the course of lowering the drive arm increases according to the deformation amount of the elastic biasing member (the arm 40*b*) and the lowering of the rocking arm stops at a time point when the load F1' is balanced against the transport load.

When the lowering of the rocking arm 30 stops as illustrated in FIG. 7(*d*), the moments have a relation of F1'×L1−F2"×L2 and the circumferential speed Vb=Va.

Since the transport grip between the drive roller and a banknote is sufficiently reduced in the state in FIG. 7(*d*), the banknote passing the nip part can freely change the direction, attitude, or transport position thereof due to an external force such as a reaction force from a sidewall without interruption of the transport.

If a slightest reaction force in a direction different from the normal transport direction is applied to a banknote due to contact with a sidewall of the banknote inserted with an abnormal transport attitude such as a skewed attitude or a misaligned attitude in FIG. 7(*d*), the drive roller 25 immediately displaces downward against biasing of the elastic biasing member 40. Accordingly, the transport grip of the drive roller on the banknote in the relation with the driven roller 102 is decreased, and correction of the attitude toward a direction to separate the banknote from the sidewall (a direction to decrease damages on the banknote from the sidewall) becomes possible.

When the transport load F2' above the predetermined value is applied in this manner to the drive roller during the forward rotation of the drive roller, a force to rock the rocking arm in the counterclockwise direction, that is, the direction to separate the rocking arm from the stopper member via the drive roller is generated.

This is explained as another example in a simplified manner. When fingers are held against the drive roller to stop the rotation (rotation on its own axis) while the input gear is rotating in the clockwise direction (the receiving direction), the drive roller (the output gear 52) starts revolving downward along the outer circumference of the input gear 50. When fingers are held against the drive roller forwardly rotating to decelerate the drive roller to a half of the circumferential speed, the speed at which the drive roller revolves downward along the outer circumference of the input gear 50 is decreased by half.

Figure 8:
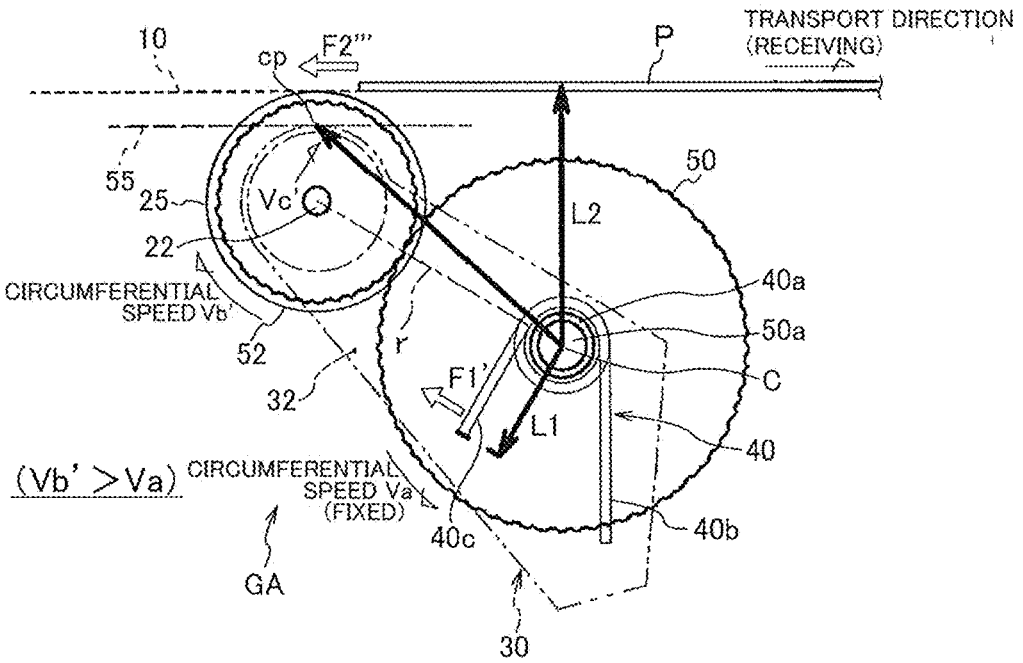
FIGS. 8(*e*) and 8(*f*) are schematic diagrams illustrating how the drive roller and the transport grip adjustment mechanism GA behave upon reception of transport load from a banknote as a relation of the behavior with moments of components.
Figure 8:
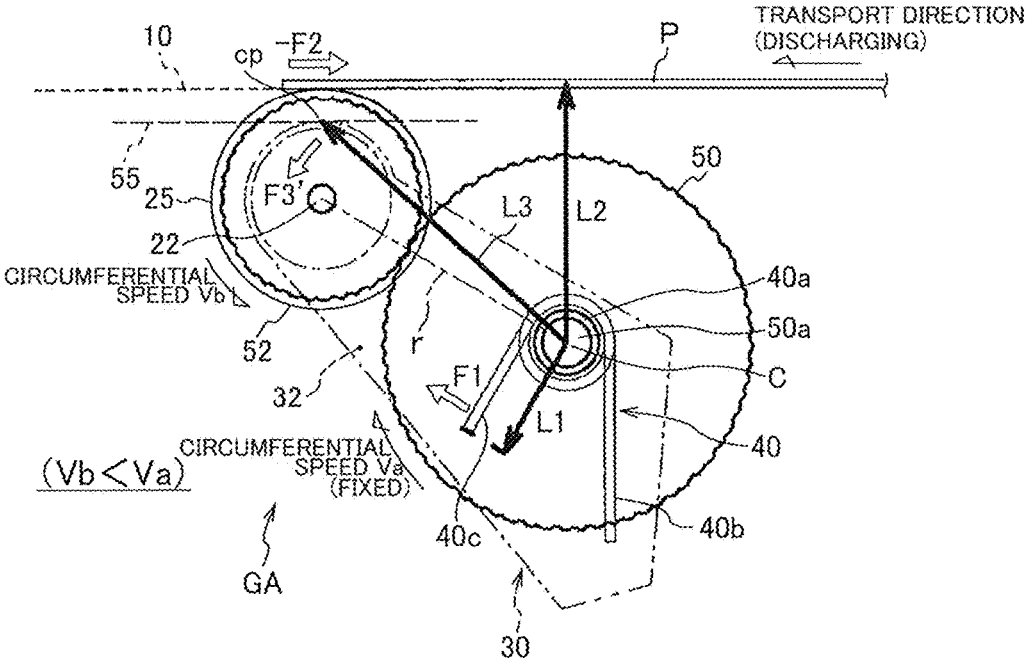

Next, FIG. 8(*e*) illustrates a state in which a banknote during receiving transport has completely passed through the nip part.

When a banknote passes through the nip part, the transport load F2 becomes zero (F2'''=0). Accordingly, the load F1' of the elastic biasing member becomes larger than the transport load F2 and the rocking arm and the drive roller at the lowered position in FIG. 8(*d*) lift and the rocking arm abuts the stopper member 55 to stop lifting (F1'×L1>F2'''×L2). When the transport load F2 becomes zero, the circumferential speed Vb' of the drive roller becomes larger than the circumferential speed Va of the input gear by a speed Vc' at which the rocking arm lifts. The rocking arm lifts due to this speed difference (Va=Vb−Vc'). That is, the output gear 52 revolves in the clockwise direction along the outer circumference of the input gear 50 due to this speed difference.

By repeating the operation from FIG. 6(*a*) to FIG. 8(*e*) for each inserted banknote, continuous feeding while performing skew correction can be performed without any decrease in the processing speed due to an intermittent operation such as a temporarily stop for skew correction.

While starting the forward rotation driving of the drive motor 60 to start driving the drive-side unit 20 at a time point when the inlet sensor 15 detects insertion of a banknote, the control unit 200 stops the drive transmission to the drive-side unit at a predetermined timing after the banknote passes through the nip part between the rollers 25 and 102. Also after that time, the drive motor 60 continues to drive transport means such the transport rollers 16*a* and 16*b* via the drive transmission members 62, thereby transmitting the banknote to the cashbox. The control unit does not bring the drive-side unit 20 to a drivable state until storage of the banknote in the cashbox is confirmed. Accordingly, even after a preceding banknote passes through the nip part as in FIG. 8(*e*), before the preceding banknote is stored in the cashbox, the drive-side unit 20 does not start the transport operation even when a following banknote is inserted into the banknote transport path and the inlet sensor 15 detects the following banknote, and thus the receiving operation is not performed.

Next, FIG. 8(*f*) is a schematic diagram illustrating a relation of moments in a transport operation to return a banknote.

At the time of returning, the rocking arm 30 is kept pressed against the stopper member 55 and the rocking arm does not rock however the load is increased Therefore, the circumferential speeds maintain the relation of Vb=Va.

That is, at the time of returning a banknote once received, the input gear 50 rotates in the clockwise direction opposite to the direction during receiving, and the drive roller 25 (the output gear 52) rotates in the counterclockwise direction. When transport load-F2 (load in the opposite direction to that of the transport load F2 applied during receiving=direction to lift the rocking arm) is applied to the drive roller 25 during this reverse rotation, the drive roller seeks to decrease the circumferential speed Vb, so that the transport load acts on the rocking arm to be intensely pressed against the stopper member 55. At this time, the rocking arm is pressed against the stopper member with a great force including the load F1 provided by the elastic biasing member 40 and the transport load-F2. Assuming a reaction force from the stopper member 55 at this time is F3', the relation of the moments is represented by F1×L1=−F2×L2+F3'×L3.

Even if the drive roller reversely rotating is pressurized by fingers or the like with a great force, the drive roller cannot be easily lowered.

When the transport load equal to or greater than the predetermined value is applied to a banknote positioned between the drive roller and the driven roller during reverse rotation of the drive roller as described above, the output gear rocks the rocking arm in a direction to be brought to pressure contact with the stopper member, and the transport grip is increased by the transport load in the reverse transport direction and the elastic biasing force of the elastic biasing member. Therefore, the returning transport can be reliably performed.

As described above, since the drive roller does not lower and does not decrease the transport grip at the time of returning, a jamming risk at the time of returning can be reduced.

Next, as already described, the spring pressure of the elastic biasing member 40 is set relatively low to be decreased to such a level of weakness that skew correction can be performed with a high responsiveness immediately when the drive roller starts displacing downward due to load from a banknote P. The principle that enables prevention of insertion of a following banknote using the elastic biasing member with a low spring pressure is explained with reference to FIG. 9.

Figure 9:
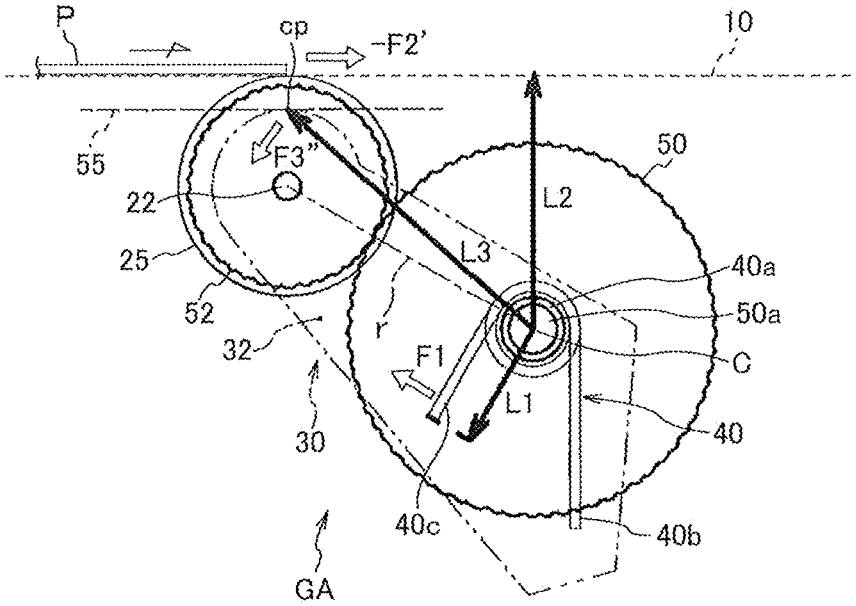
FIG. 9 is an explanatory diagram of a principle that enables prevention of insertion of a following banknote using an elastic biasing member with a low spring pressure.

That is, when a banknote is being forced to be pushed into the nip part between the drive roller 25 and the driven roller 102 that are stopped illustrated in FIG. 9, load-F2' in the same direction as that during receiving of the banknote is generated by the banknote to the drive roller 25. Assuming a reaction force from the stopper member 55 at this time is F3", the relation of the moments is represented by F1×L1=−F2'×L2+F3"×L3. Accordingly, similarly at the time of returning illustrated in FIG. 8(*f*), a force to move toward the driven roller (a moment F2'×L2 acting in the lifting direction) additionally acts on the drive roller. Therefore, the transport grip does not decrease and a banknote is hard to be inserted at the time of stopping the drive transmission mechanism DM.

[Skew Correcting Operation During Forward Rotation]

Figure 10:
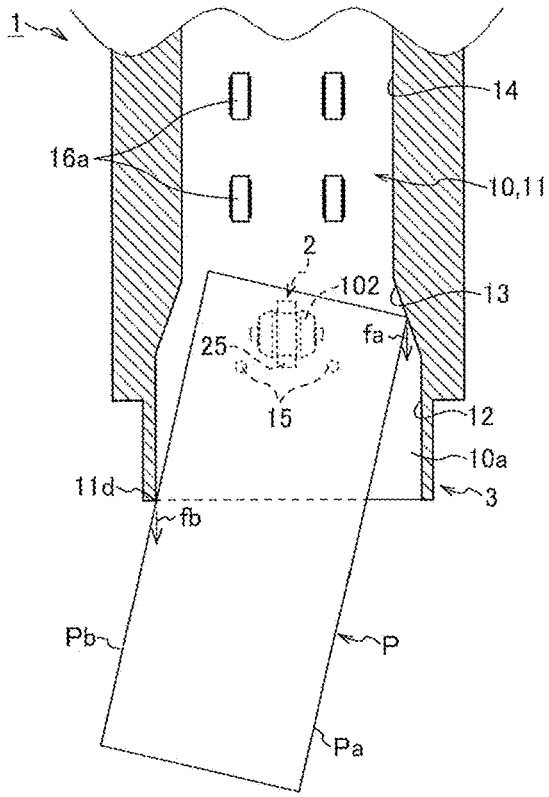
FIGS. 10(*a*) and 10(*b*) are respectively a plan view and an enlarged view of relevant parts of a banknote transport path (the friction transport device).
Figure 10:
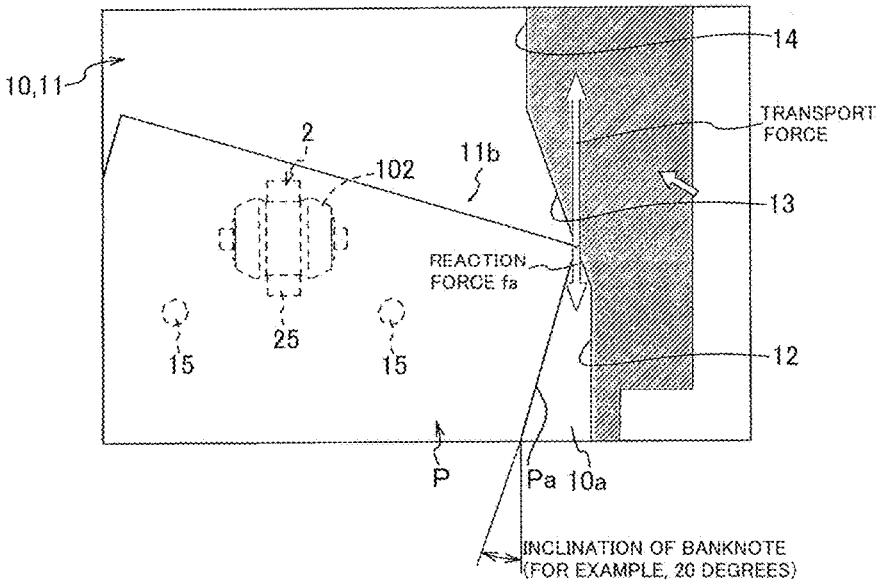
Figure 11:
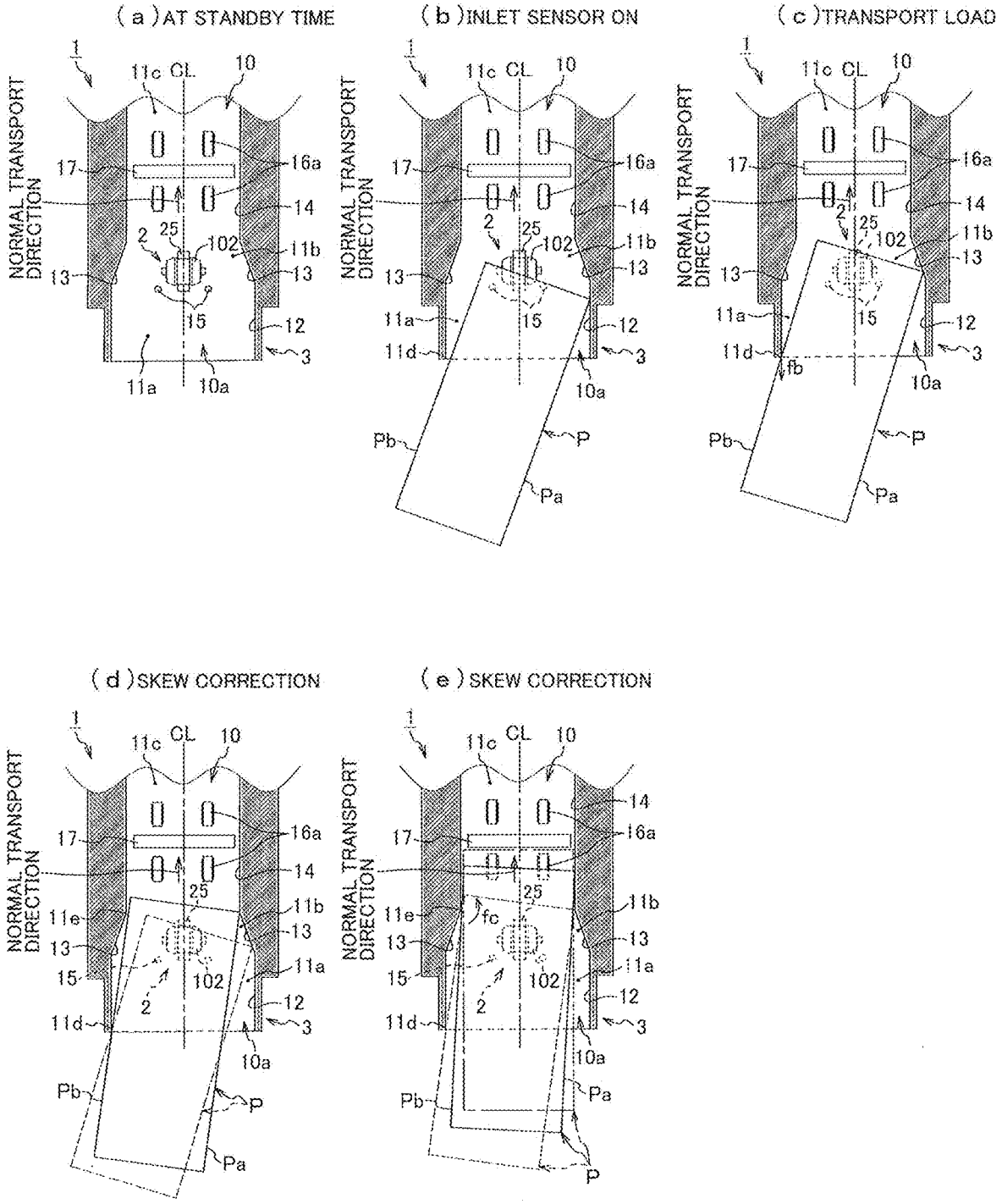
FIGS. 11(*a*) to 11(*e*) are plan views of the banknote transport path for explaining a procedure in which a banknote having entered the banknote transport path in a skewed state is subjected to skew correction in the course of advancing.
Figure 12:
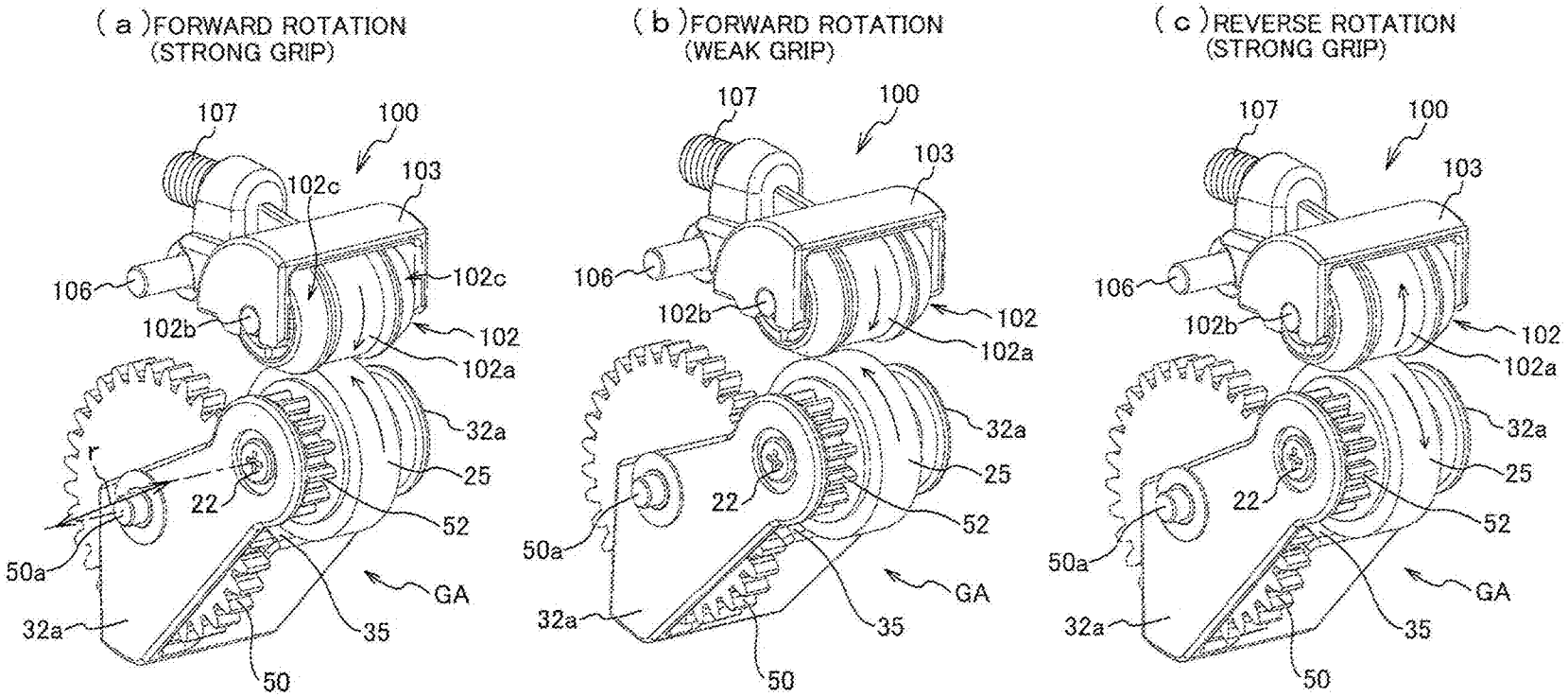
FIG. 12 are explanatory diagrams of a procedure of a skew correcting operation of the drive-side unit, where FIG. 12(*a*) is a perspective view illustrating a state in which the drive roller is forwardly rotating in a state closest to the driven roller, FIG. 12(*b*) is a perspective view illustrating a state in which the drive roller forwardly rotating is separated from the driven roller, and FIG. 12(*c*) is a perspective view illustrating a state in which the drive roller is reversely rotating.

FIGS. 10(*a*) and 10(*b*) are respectively a plan view and an enlarged view of relevant parts of the banknote transport path in a state in which skew occurs, FIGS. 11(*a*) to 11(*e*) are plan views of the banknote transport path for explaining a procedure in which a banknote having entered the banknote transport path in a skewed state is subjected to skew correction in the course of advancing, FIG. 12 are explanatory diagrams of a procedure of a skew correcting operation of the drive-side unit and the like, where FIG. 12(*a*) illustrates a state in which the drive roller is forwardly rotating in a state closest to the driven roller and the grip is strong, FIG. 12(*b*) illustrates a state in which the drive roller forwardly rotating is separated from the driven roller and the grip is weak, and FIG. 12(*c*) illustrates a state in which the drive roller is reversely rotating in a state closest to the driven roller and the grip is strong.

The skew correcting operation is explained below in more detail with reference to FIGS. 4 to 12.

At the standby time before receiving a banknote, the drive roller 25 is at the most lifted position (the closest position, the initial position) under the load from the elastic biasing member 40 constituted of a compressed spring, and is in a state where the outer circumferential surface is in contact (pressure contact) with the outer circumferential surface of the driven roller 102 with a strong force (FIG. 5(*a*-1) and FIG. 11(*a*)). Due to restriction of the rocking arm in the lifted position by the stopper member 55, the pressure at which the drive roller is in contact with the driven roller is defined not to exceed a predetermined value.

When a banknote with an attitude inclined rightward is inserted from the inlet 10*a* as in FIGS. 4 and 11(*b*) at the standby state of the friction transport device 2, the inlet sensor 15 detects the banknote P, and the drive motor 60 transmits the driving force in the forward rotation direction indicated by an arrow to a gear portion of the output gear 52 via the input gear 50, to rotate the drive roller 25 in the forward direction indicated by an arrow direction as in FIG. 5(*b*-1). The banknote P is transported to an inner side of the banknote transport path 10 by a strong transport grip between the circumferential surface of the drive roller forwardly rotating and the banknote surface (see FIG. 6(*b*)). Since the transport grip adjustment mechanism GA is not actuated at this time point, slide does not occur between the banknote and the drive roller.

The drive roller 25 is biased upward (in a direction to increase the transport grip) by the elastic biasing member 40. However, when a slightest difference is produced in the rotation speed between the drive roller (the output gear 52) and the input gear 50 due to the transport load, the transport grip adjustment mechanism GA is actuated and a force to move the drive roller downward against the biasing by the elastic biasing member, that is, the transport load F2' is generated (see FIG. 7(*c*)). That is, the moment F1×L1 for rotating the rocking arm in the lifting direction becomes inferior to the moment F2×L2 for rotating the rocking arm in the lowering direction, and the rocking arm lowers (rotates). In FIG. 7(*c*), c denotes a moving direction of the rocking arm and Ve denotes a speed at which the rocking arm moves in the direction c.

In the state in FIG. 5(*b*-1), the outer circumferences of the drive roller 25 and the driven roller 102 are in contact with each other at the apexes (the outer circumferential surface) and transport the banknote P while nipping the central portion of the banknote in the width direction warped in an inverted U shape (upward) (grip transport). In the forward rotation state (grip transport) in FIG. 5(*b*-1), the transport grip at the nip part with the driven roller 102 is strong enough to stably transport the banknote in the normal transport direction. However, in the forward rotation state (gap transport) of the drive roller in FIG. 5(*b*-2), the transport grip adjustment mechanism GA starts being actuated, whereby the drive roller starts displacing in the direction away from the driven roller. Accordingly, the transport grip is weaker than that in the grip transport state in FIG. 5(*b*-1).

A banknote P inserted by a user from the inlet 10*a* of the banknote transport path 10 in a state inclined at a predetermined acceptable angle or larger with respect to the normal transport direction indicated by an arrow as illustrated in FIGS. 10(*a*) and 11(*c*) is brought to a state in contact with one of the intermediate sidewalls 13 at a leading end corner portion of a right side edge Pa of the banknote P and in contact with an inlet-side end part 11*d* of one of the inlet-side sidewalls 12 at a left side edge Pb of the banknote in the course of transport toward the back by the friction transport device 2. When the leading end corner portion of the banknote being transported is brought to contact with a sidewall surface and the left side edge Pb is brought to contact with the inlet-side end part 11*d*, the banknote is decelerated under reaction forces fa and fb (transport load) from the contact portions.

As illustrated in FIGS. 10(*a*), 10(*b*), and 11(*c*), with the contact of the leading end corner portion of one side edge Pa of the banknote P with one of the intermediate sidewalls 13 as the tapered surfaces, the banknote P is subject to the reaction force (an arrow fa) in a direction different from the normal transport direction. At an instant when the corner portion of the banknote is brought to contact with the intermediate sidewall 13, the driver roller 25 is in the central recessed portion 102*a* of the driven roller 102 having a substantially tsuzumi shape (a shape including a recessed portion on the outer circumference at the axially central portion) and is in contact therewith as illustrated in FIG. 5(*b*-1). Therefore, the reaction force fa that the banknote P receives from the intermediate sidewall 13 is smaller than the transport grip between the drive roller 25 and the banknote and the moving direction of the banknote P accordingly does not change (moves straight ahead). On the other hand, immediately after the contact with the intermediate sidewall, the drive roller starts displacing downward (in the direction to decrease the transport grip) against the elastic biasing force due to increase in the transport load caused by the reaction force fa received by the banknote P and the transport grip rapidly decreases. That is, by actuation of the transport grip adjustment mechanism GA due to increase in the load caused by the reaction force fa, the drive roller moves downward to form a space from the driven roller and decrease the transport grip to cancel the reaction force fa from the intermediate sidewall 13 acting on the banknote P as illustrated in FIGS. 5(*b*-2) and 12(*b*). When the transport grip acting on the banknote P becomes smaller than the reaction force fa received from the intermediate sidewall 13, the banknote P can be shifted in a direction to cancel the reaction force fa from the wall surface, that is, a direction to be aligned with the central axis CL of the banknote transport path 10, and the aligned attitude.

A relation between a reaction force fb generated by contact between the left side edge Pb of the banknote and the inlet-side end part 11*d*, and the transport grip is the same as the relation between the reaction force fa and the transport grip.

It is to be noted that the transport grip adjustment mechanism GA only functions to decrease the transport grip at the time of actuation and it is the reaction force from a sidewall or the like that corrects the transport direction of a banknote.

Next, the friction transport device 2 can also handle a banknote largely skewed by about 20 degrees as illustrated in FIG. 10(*b*). While the angle of the skew in this case is 20 degrees, this is merely an example.

That is, when the reaction forces fa and fb from sidewall surfaces are successively applied to the drive roller 25 via a banknote P in a state in which the transport grip between the drive roller 25 and the banknote P is larger than the reaction forces fa and fb (FIGS. 5(*b*-1) and 12(*a*)), the reaction forces fa and fb act as rotation load for the drive roller and the transport speed of the banknote P and the rotation speed of the drive roller are both decreased.

That is, since there is a large frictional resistance between the drive roller 25 and the banknote P, the rotation speed of the drive roller decreases with the deceleration of the banknote. At this time, the rocking arm 30 lowers due to the difference in the rotation speed between the output gear 52 and the input gear 50 and accordingly the drive roller also starts lowering (FIGS. 5(*b*-2), 12(*b*), and 7(*c*)).

In the course of downward movement of the drive roller 25, a space is formed between it and the circumferential surface (the central recessed portion 102*a*) of the driven roller 102 and the transport grip decreases.

In the state in FIG. 7(*c*) where the transport grip starts decreasing, the banknote P starts sliding on the surface of the drive roller toward a central portion of the transport path to release the transport load. In response to a change of the transport load, the amount of downward movement of the drive roller changes.

When the transport grip acting on the banknote P becomes smaller than the reaction forces fa and fb received from the sidewalls and the banknote then starts sliding, the downward movement of the drive roller 25 stops (FIG. 7(*d*)).

In FIG. 11(*c*), the banknote is in a state in which the leading end right corner portion is in contact with the right intermediate sidewall 13 and the left side edge Pb is in contact with the inlet-side corner part 11*d*. In a state in which the banknote further advances as in FIG. 11(*d*), the leading end portion of the banknote enters the back transport surface 11*c* and finally takes an attitude parallel to the back sidewalls 14 (completion of skew correction). Specifically, since the banknote advances while rotating in the counterclockwise direction under the force in a rotation direction indicated by an arrow fc due to a reaction force generated at a contact point between a corner portion 11*e* of the terminal end portion of the left intermediate sidewall 13 and the left side edge Pb of the banknote in the state in FIG. 11(*e*), the transport attitude can be corrected.

In a state in which the drive roller stops lowering in FIG. 5(*b*-2), the drive roller forwardly rotates at the equal speed to that of the input gear 50 as explained with reference to FIG. 7(*d*) (Vb=Va).

In this way, the drive roller 25 automatically and unintermittently moves in a direction to reduce the transport grip until the transport grip decreases to an appropriate value enough to cancel the transport load acting on the banknote P. Since the drive roller lowers unintermittently, the behavior of the banknote becomes continuous and stable.

A banknote P always has a contact point with each of the drive roller 25 and the driven roller 102 because of its own "stiffness" (flexural rigidity, firmness). Therefore, a banknote can continuously receive the transport force even when the transport grip is weak and the drive roller 25 is retreated downward.

As described above, according to the friction transport device 2 of the present invention, when the transport grip acting on a banknote P from the nip part between the drive roller 25 and the driven roller 102 becomes smaller than the reaction force received by the banknote from one of the intermediate sidewalls 13, the banknote P starts sideslipping on the drive roller 25 and is transported toward the center of the banknote transport path along the sidewall surface while changing the attitude in the direction to cancel the reaction force from the wall surface, to be aligned with the central axis CL of the banknote transport path.

When the banknote P is aligned with the normal position or attitude, the contact with the sidewall surface is eliminated, and no reaction force is applied, the drive roller 25 moves upward due to the pressing force of the elastic biasing member 40 to return to the original position.

The friction transport device 2 has the configuration in which the transport grip adjustment mechanism GA is in the inactivated state at the time of returning a banknote P or at the standby time, and the drive roller 25 does not move downward from the initial position. Therefore, a banknote P can be returned with a strong transport grip and continuous insertion can be prevented.

As for the elastic member 107 that biases the driven roller 102, the transport grip between the drive roller forwardly rotating and a banknote becomes low if the elastic biasing force is set low. Therefore, when a banknote in a skewed state enters the nip part between the rollers, it is difficult to return the banknote. Accordingly, it is effective for returning that the load of the elastic member 107 is set high to increase the transport grip. In other words, if the load of the elastic member 107 is set to a predetermine value or lower, the transport grip is decreased and this is disadvantageous for returning.

FIG. 11 illustrate a case in which the leading end right corner portion of a banknote is brought to contact with one of the intermediate sidewalls 13 as a result of oblique insertion of the banknote from the inlet 10*a*. However, also in a case in which the insertion attitude of a banknote is in a non-skewed state, that is, a state parallel to the normal transport direction, a reaction force to be received by the banknote from a sidewall is generated when the banknote is inserted close to the right side (or close to the left side) of the transport path to such an extent that the leading end right corner portion is brought to contact with one of the intermediate sidewalls 13. Accordingly, the transport grip adjustment mechanism GA is actuated and shows a behavior to move the banknote in the width direction toward the central portion of the width direction of the transport path.

That is, not only in the case in which a banknote is inserted in a skewed state but also in all cases in which a banknote is inserted with a leading end corner portion of the banknote in contact with one of the tapered sidewalls 13, the friction transport device 2 of the present invention can correct the transport position in the width direction by actuating the transport grip adjustment mechanism GA.

[Reverse Rotation Operation at the Time of Banknote Return]

The reverse rotation operation of the drive roller at the time of returning a banknote P is explained next.

In order to actuate the transport grip adjustment mechanism GA to correct the transport position or the transport attitude of a banknote to the normal state at the time of receiving the banknote, the transport grip between the drive roller and the banknote needs to be decreased. On the other hand, at the time of reversely rotating the drive roller to return a banknote once introduced when jam or the like occurs in the banknote, there is a problem in jam handling that a force for returning transport becomes small if the transport grip is weak. That is, there have been antinomic requirements that the transport grip is to be weakened to correct the transport position or attitude of a banknote once introduced to an appropriate position or attitude while a sufficiently strong transport grip is required for returning. No conventional technique to meet these requirements with a simple and low-cost configuration has been developed.

According to the present invention, these antinomic requirements can be met with a simple and low-cost configuration. Particularly, the present invention is characterized in that continuous and nonintermittent transport can be performed both in the case of forward rotation of the drive roller and the case of reverse rotation thereof.

FIGS. 5(*a*-3) and 5(*b*-3) are front views illustrating a state in which the drive-side unit is reversely rotating. FIG. 8(*f*) is also referred to.

When an error occurs such as in a case in which the control unit 200 determines that a banknote P inserted from the inlet 10*a* is unacceptable based on a result (such as counterfeiting, soilure, deformation, or jam) of recognition by the recognition sensor 17, the control unit 200 performs an operation to return the rejected banknote to the inlet 10*a* by causing the drive motor 60 to reversely rotate the input gear 50, the output gear 52, and the drive roller 25. As explained with reference to FIG. 8(*f*) related to the behavior at the time of returning, since the transport load –F2 (load in the direction to lift the rocking arm) is initially not generated, the rocking arm 30 is pressed against the stopper member 55 and the rocking arm does not lower. At this time, the relation between the circumferential speed Va of the input gear 50 and the circumferential speed Vb of the output gear 52 is Va=Vb. When reverse rotation of the drive roller 25 is started for returning, the transport load-F2 is applied to the drive roller 25 and the circumferential speed Vb of the drive roller is being decreased (Vb<Va). Therefore, by the action of the transport load, the rocking arm is intensely pressed against the stopper member 55. In cooperation of this pressing force and the load from the elastic biasing member 40, the drive roller continues to maintain the most lifted position where the transport grip is strong and does not move in the direction away from the driven roller even when the drive roller receives rotational load from outside. At the time of reversely transporting a banknote P to the inlet 10*a*, the drive roller can sandwich the banknote P with the driven roller 102 with a sufficient transport grip to back transport the banknote.

At this time, since the drive roller 25 does not lower, the return can be advantageously performed while the strong grip is maintained. That is, when the drive roller reversely rotates for returning, the transport grip is not decreased regardless of whether there is a banknote, or the transport state.

As described above, at the time of reverse rotation of the drive roller, the drive roller is at the most lifted position and maintains a state in intense contact with the driven roller 102 regardless of whether the transport load is large or small. Therefore, the transport grip and the returning force are strong, and the back transport can be easily and reliably performed. Furthermore, the returning force at the time of banknote jam becomes strong.

[Insertion Prevention at Standby Time]

Insertion prevention (prevention of two consecutive insertion) at the standby time is explained next.

Figure 13:
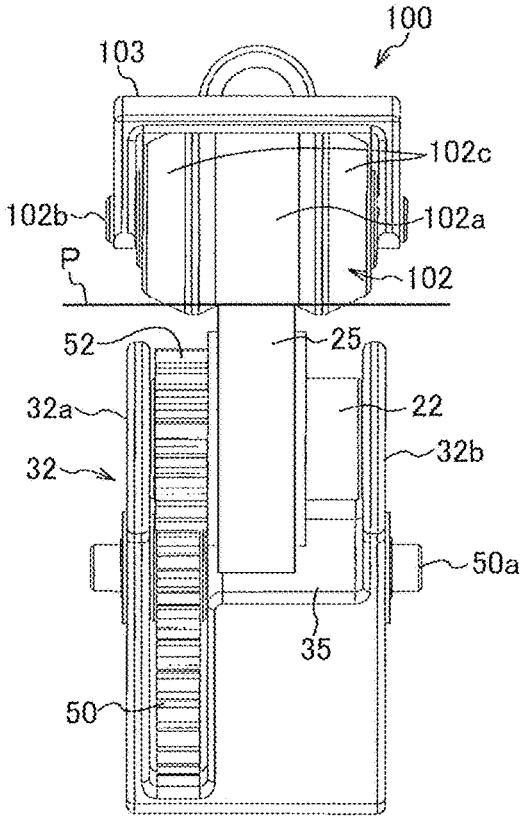
FIG. 13 is a front view illustrating a state of the friction transport device at a standby state in which a second banknote is not received.

FIG. 13 is a front view illustrating a state of the friction transport device at the standby state in which a second banknote is not received because a first banknote precedingly inserted is being processed. FIG. 13 illustrates a state in which a following banknote P cannot enter an inverted U-shaped space formed between the drive roller and the driven roller.

The banknote transport device 1 is installed in a banknote handling device such as a vending machine or a change machine, and an input banknote is stored in the cashbox after recognition by the recognition sensor 17. For the banknote handling device, there is a requirement that the drive roller 25 arranged near the inlet 10*a* and the transport rollers 16*a* are driven by a single drive motor 60 to simplify the configuration and reduce the cost. However, in a type using a single drive motor, when insertion of a following banknote is detected by a banknote detection sensor (a paper sheet detection sensor, not illustrated) inside the transport path before storage processing to a first banknote is not completed, a problem that the drive roller and the transport rollers are both reversely rotated and the both banknotes are forced to be returned in a lump occurs. In order to address this problem, a need to prevent insertion of a following banknote with no exception before completion of storage processing to a preceding banknote arises.

However, the transport grip needs to be decreased to provide the skew correcting function with the drive roller at the time of receiving a banknote while the transport grip needs to be set strong to prevent insertion of a following banknote. It is conventionally difficult to meet these two requirements at the same time.

In contrast thereto, according to the banknote transport device 1 (the banknote handling device) including the friction transport device 2 of the present invention, even when a second banknote is being consecutively inserted after stop of the drive roller, capture of the banknote can be prevented because a grip (a nip force) at the contact point between the drive roller 25 in the stopped state and the driven roller 102 is strong enough to prevent the insertion. In this manner, since the friction transport device 2 includes an automatic grip adjustment function in the present invention, insertion of a following banknote can be prevented by stopping driving of the drive roller immediately after a first banknote passes the drive roller.

Figure 15:
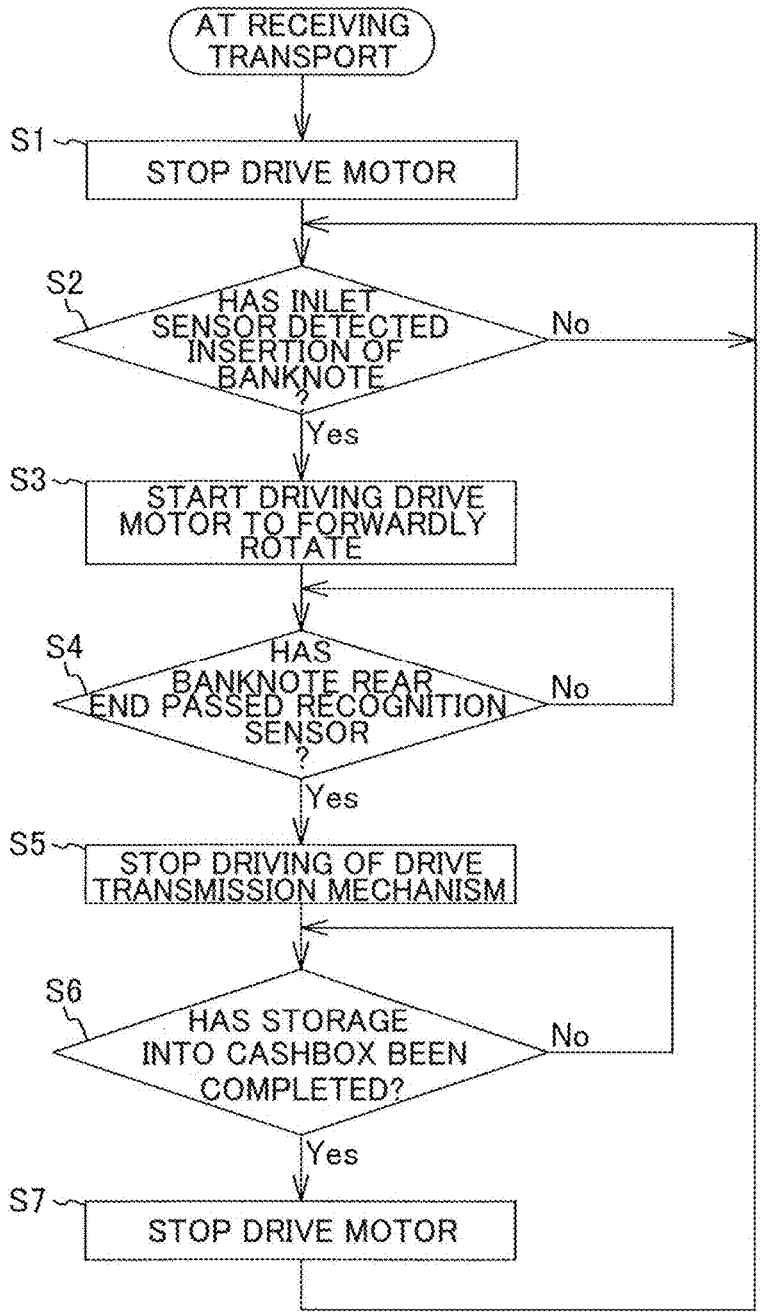
FIG. 15 is a flowchart illustrating a transport procedure performed by the friction transport device of the present invention.

As described above, in the banknote transport device 1 of the present invention, the friction transport device 2 has stopped the transport operation for receiving at a time point when a first banknote has been already transported into the banknote transport path 10 from the inlet 10*a* through the friction transport device 2 and processing for storage into the cashbox is completed. Therefore, the transport grip is strong and the standby state in which a second banknote is not received is maintained. That is, after the rear end of a first banknote passes the recognition sensor 17 located downstream from the drive roller, the control unit 200 interrupts the driving force transmission to the input gear 50 for a certain period and stops driving of the drive roller 25 to be brought to the standby state (FIG. 15, Steps S1 to S5).

At the standby state in which the drive roller stops being driven, the grip at the contact point with the driven roller is kept at a strong state regardless of whether there is a banknote, or the transport state.

In this standby state, the drive roller 25 and the driven roller 102 are in the stopped state and the apexes of the outer circumferential surfaces thereof are close to each other. Since the drive roller during stop is at the most lifted position and keeps a strong grip with the driven roller, insertion of a second banknote P can be effectively prevented unless the drive roller rotates.

A primary factor that makes insertion of a banknote into the nip part between the drive roller and the driven roller during stop of driving difficult is the spring pressure of the elastic biasing member 40 that biases the drive roller. Therefore, the shapes of the outer circumferential surfaces of the drive roller and the driven roller are secondary as elements for increasing the transport grip at the standby time, and are not limited to the shapes illustrated in the drawings.

The control unit 200 drives the drive motor 60 to forwardly rotate the transport pulleys 16*a* and 16*b* via the drive transmission mechanism DM and continues transport of the banknote also after stopping transmission of the driving force to the drive roller 25 at Step S5. Subsequently, at a time point when storage of the banknote into the cashbox is detected, the control unit 200 stops the drive motor (Steps S6 and S7).

[Returning Operation for Card]

Next, a returning operation in a case in which a plate-like medium, such as a card, that is harder, shorter, and thicker than a banknote is erroneously inserted is explained.

At the time of receiving a banknote, the transport grip adjustment mechanism GA is actuated in response to increase in the transport load, whereby the drive roller 25 lowers.

On the other hand, at the time of receiving a card, a banknote and a card cannot be discriminated. Therefore, even when an inserted object is a card, the inlet sensor 15 is turned ON and the card is received. At a time when the card passes the nip part between the drive roller and the driven roller, the transport grip adjustment mechanism GA is actuated according to the transport load, and the drive roller lowers. However, the transport grip does not change.

Figure 14:
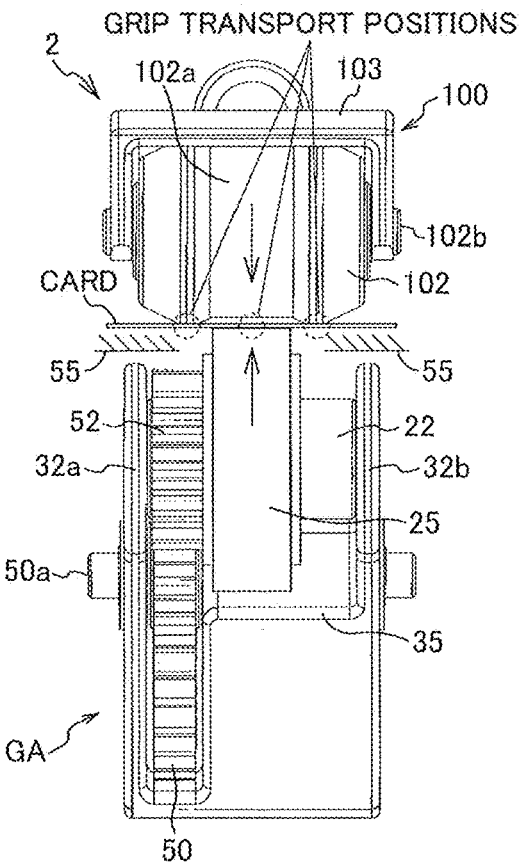
FIG. 14 is a front view at the time of card transport by the friction transport device.

That is, when a card medium being thicker and harder than a banknote is inserted into the nip part and the inlet sensor 15 is turned ON to start transporting the card, the drive roller intensely nips the card with the driven roller 102 and maintains this state as illustrated in a front view (strong grip) at the time of card transport by the friction transport device in FIG. 14. Accordingly, the transport grip does not change (the device does not proceed to the gap-type transport) and the drive roller continues to nip the card with the driven roller 102. Therefore, the transport grip does not change and the strong grip state is maintained. Three locations indicated by circles in FIG. 14 are grip transport positions.

Also at the time of receiving a card and the time of returning a card, the strong grip is maintained at these grip transport positions.

A lowering stopper (not illustrated) is provided to define the lowering limit position of the transport grip adjustment mechanism GA (the rocking arm), and lowering is stopped by causing the rocking arm 30 to abut the lowering stopper.

In order to restate the foregoing, at the time of receiving transport of a card, the transport grip adjustment mechanism GA performs a lowering operation according to the transport load while the intense nipping (grip transport) with the driven roller is maintained because the card is hard (the device does not shift to the gap-type transport). Furthermore, due to the presence of the lowering stopper that defines the lowering limit of the rocking arm, there is a limitation in the lowering amount of the transport grip adjustment mechanism GA and the driven roller is raised because the card is thick.

That is, when a hard medium M such as a card is erroneously inserted into the banknote transport path 10 during the standby state illustrated in FIG. 6(*a*), the inlet sensor 15 detects the insertion, and receiving transport is performed, the control unit 200 shifts to the returning operation in response to length detection by a position sensor or a paper sheet sensor (not illustrated), and causes the drive motor 60 to perform the reverse rotation operation to reversely rotating the drive roller via the input gear 50.

When reversely rotating, the drive roller 25 continues to maintain the most lifted position and does not lower due to the rocking arm 30 that is at the lifted position, so that the strong transport grip is not decreased.

A reason why the drive roller does not lower and the state in which the transport grip is strong can be maintained at the time of reverse rotation of the drive roller is that the rocking arm is held at a position where the transport grip is strong by the load F1 provided by the elastic biasing member 40 and the transport load −F2 during the reverse rotation as explained with reference to FIG. 8(*f*).

At the time of returning transport, the driven roller 102 is raised by the thickness of the card medium against the biasing of the elastic member 107, and returning can be effectively performed with the strong transport grip.

In the present embodiment, the driven roller 102 is raised when a card is nipped because cards have less flexibility than banknotes. At this time, since the transport grip is increased by biasing the driven roller against the drive roller with the elastic member 107, a card can be more reliably returned by reversely rotating the drive roller.

As described above, in the present embodiment, when a card is erroneously inserted, the length and the like thereof are detected by a position sensor (not illustrated) or the like to detect that the inserted object is a card (not a banknote). Also at the time of receiving a card and the time of returning it, the driven roller 102 is raised to cause the transport grip to reliably function and the returning force can be increased.

APPLICATION EXAMPLE OF EMBODIMENT

First Application Example

Figure 16:
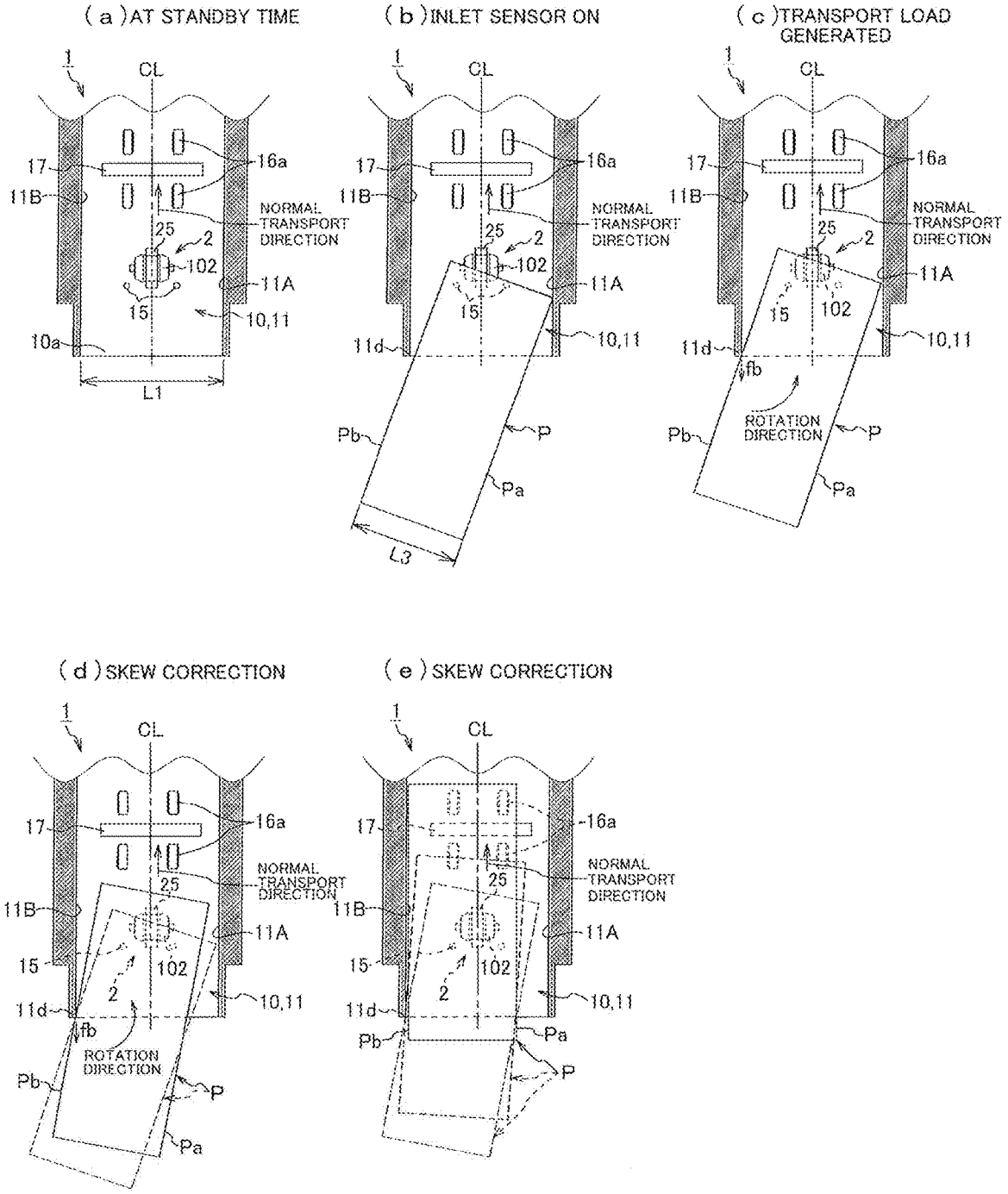
FIGS. 16(*a*) to 16(*e*) are plan views of relevant parts, illustrating a skew correcting procedure in a case in which the friction transport device of the present invention is applied to a banknote transport path that is wide and constant in the width.

FIGS. 16(*a*) to 16(*e*) are plan views of relevant parts, illustrating a skew correcting procedure in a case in which the friction transport device of the present invention is applied to a banknote transport path that is wide and constant in the width.

The friction transport device 2 of the present invention can be applied not only to the banknote transport path 10 (the banknote transport surface 11) that is not constant in the width dimension as illustrated in FIG. 2(*a*) but also to a banknote transport path that is constant in the width dimension to correct the position, angle, and attitude of a banknote inserted in a skewed state to a normal state.

In the example of FIGS. 16, a width dimension L1 of the banknote transport path 10 is 86 mm and a width dimension L3 of a banknote to be transported is 66 mm.

Also in a case in which the friction transport device 2 is applied to the wide banknote transport 10, the position, angle, and attitude of a banknote are corrected by substantially the same operating principal and procedure as those in the case in which the friction transport device is applied to the banknote transport path that is not constant in the width dimension illustrated in FIG. 2 and other drawings, and a transport state in which the banknote is aligned with one of sidewalls (or the central axis CL) can be obtained.

When a banknote P is inserted from the inlet 10*a* to the friction transport device 2 in the standby state in FIG. 16(*a*), the inlet sensor 15 detects the insertion and is turned ON to cause the drive motor 60 to start driving the drive roller 25 in the forward rotation direction as illustrated in FIG. 16(*b*). When the inserted banknote is skewed at a certain angle in the clockwise direction as illustrated in FIGS. 16(*b*) and 16(*c*), the left-side end edge Pb of the banknote P is brought to contact with the inlet-side end part 11*d* and is subject to the reaction force fb. While a case in which the leading end corner portion of the banknote is brought to contact with one of the tapered intermediate sidewalls 13 is described in FIG. 2 and other drawings, the actuating procedure of the transport grip adjustment mechanism GA with respect to the reaction force fb is substantially the same in the present example. That is, upon reception of the reaction force fb from the inlet-side end part 11*d* on the left-side end edge Pb of the banknote, the transport grip adjustment mechanism GA is actuated to weaken the transport grip between the drive roller and the banknote, and can efficiently perform the skew correcting operation to transport the banknote while sideslipping the banknote and rotating the banknote in the counterclockwise direction on the contact portion between the left-side end edge of the banknote and the inlet-side end part. In the present example, the corrected banknote P is transported to the inner back part in a straight advancing attitude with the left-side end edge Pb in parallel to the left sidewall 11B as indicated by a solid line in FIG. 16(*e*).

At the time of returning a banknote P and the standby time, returning transport and insertion prevention can be effectively realized by maintaining the state in which the transport grip is strong.

Second Application Example

Figure 17:
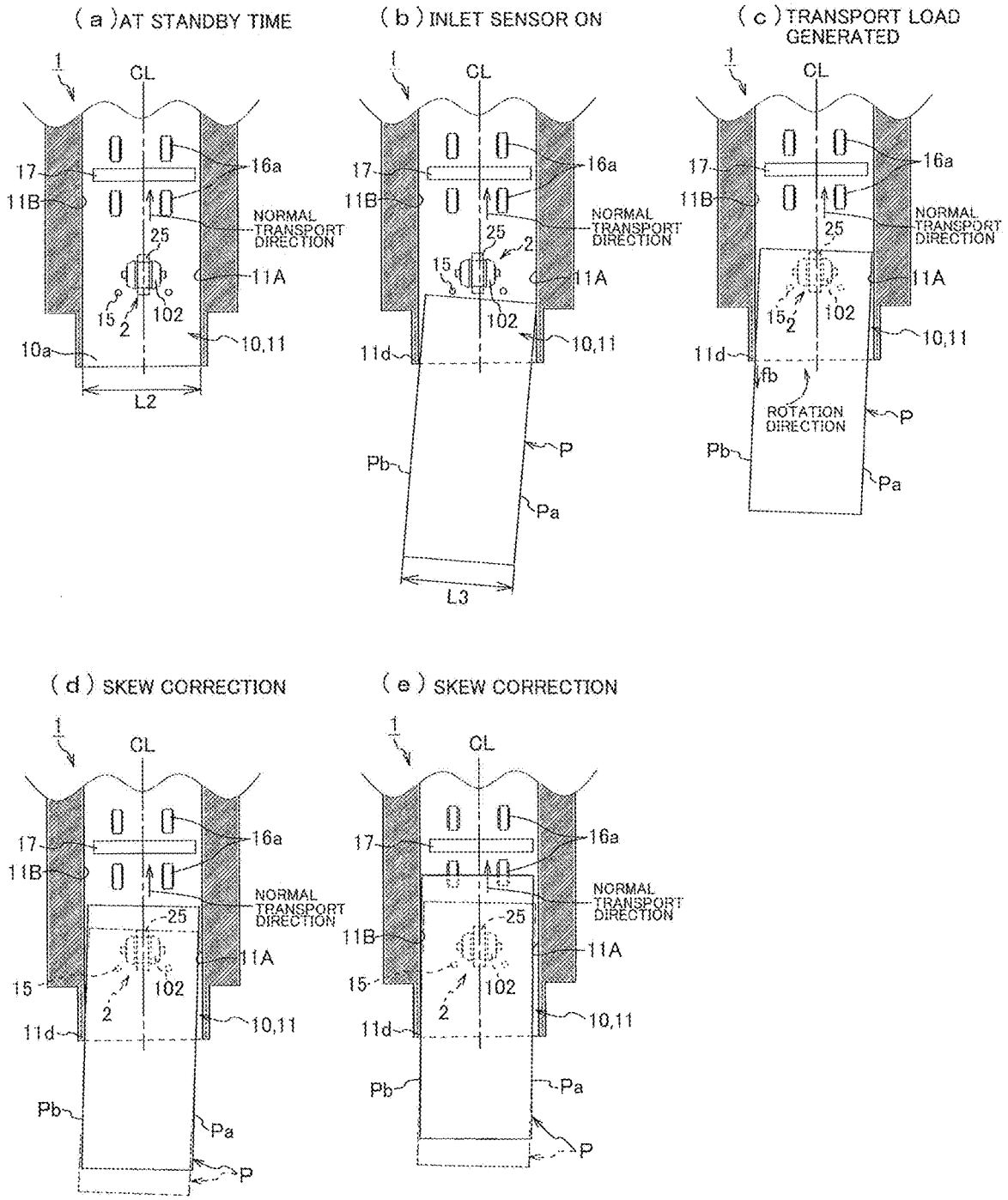
FIGS. 17(*a*) to 17(*e*) are plan views of relevant parts, illustrating a skew correcting procedure in a case in which the friction transport device of the present invention is applied to a banknote transport path that is narrow and constant in the width.

FIGS. 17(*a*) to 17(*e*) are plan views of relevant parts, illustrating a skew correcting procedure in a case in which the friction transport device of the present invention is applied to a banknote transport path that is narrow and constant in the width.

In the example of FIGS. 17, a width dimension L2 of the banknote transport path 10 is 68 mm and the width dimension L3 of a banknote to be transported is 66 mm.

Also in a case in which the friction transport device 2 is applied to the narrow banknote transport path 10, the position, angle, and attitude of a banknote are corrected by substantially the same operating principle and procedure as those in the case in which the friction transport device is applied to the banknote transport path having different widths illustrated in FIG. 2 and other drawings, and a transport state in which the banknote is aligned with a central portion of the transport path or the left sidewall can be obtained.

When a banknote P is inserted from the inlet 10*a* to the friction transport device 2 in the standby state in FIG. 17(*a*), the inlet sensor 15 detects the insertion and is turned ON to cause the drive motor 60 to start driving the drive roller 25 in the forward rotation direction as illustrated in FIG. 17(*b*). When the inserted banknote is skewed at a certain angle in the clockwise direction as illustrated in FIG. 17(*b*), the left-side end edge Pb of the banknote P is brought to contact with the inlet-side end part 11*d* and is subject to the reaction force fb. While the case in which the leading end corner portion of the banknote is brought to contact with one of the tapered intermediate sidewalls 13 is described in FIG. 2 and other drawings, the actuating procedure of the transport grip adjustment mechanism GA with respect to the reaction force fb is substantially the same in the present example. That is, upon reception of the reaction force fb from the inlet-side end part 11*d* on the left-side end edge Pb of the banknote, the transport grip adjustment mechanism GA is actuated to weaken the transport grip between the drive roller and the banknote, and can efficiently perform the skew correcting operation to transport the banknote while sideslipping the banknote and rotating the banknote in the counterclockwise direction on the contact portion between the left-side end edge of the banknote and the inlet-side end part.

In the present example, the corrected banknote P is transported to the inner back part in a state in which a central portion of the banknote in the width direction is aligned with a central portion of the transport path 10 in the width direction and in a straight advancing attitude as indicated by a solid line in FIG. 17(*e*).

At the time of returning a banknote P and the standby time, returning transport and insertion prevention can be effectively realized by maintaining the state in which the transport grip is strong.

Second Embodiment

Figure 18:
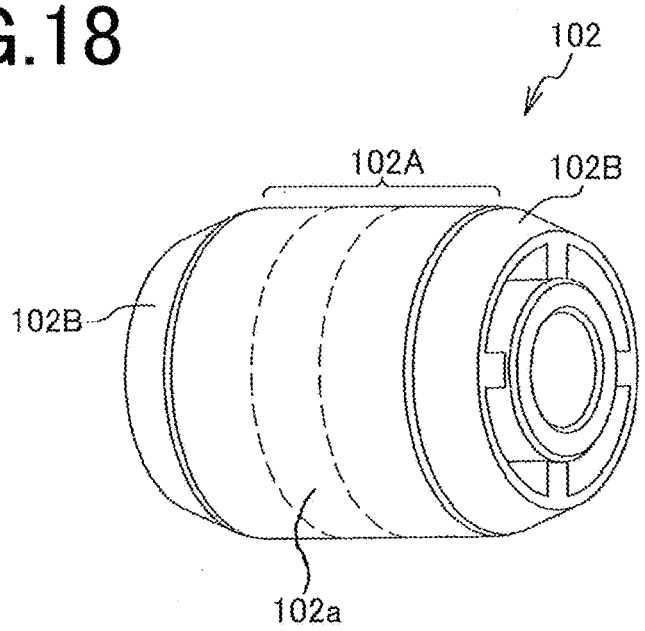
FIG. 18 is an external perspective view for explaining a configuration of a driven roller according to a modified embodiment (a second embodiment) of the present invention.
Figure 19:
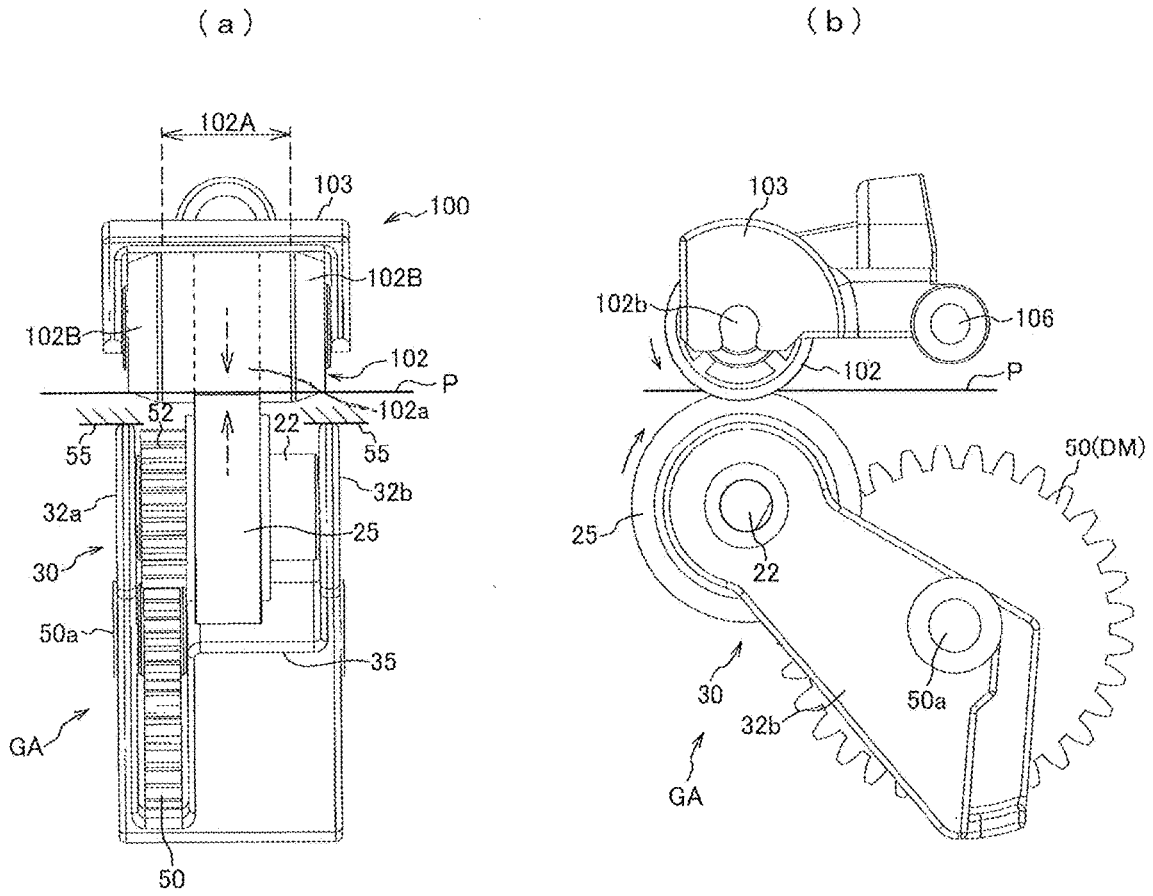
FIGS. 19(*a*) and 19(*b*) are respectively a front view and a side view of a friction transport device using the driven roller according to the modified embodiment at the time of receiving a banknote (with a strong transport grip).
Figure 20:
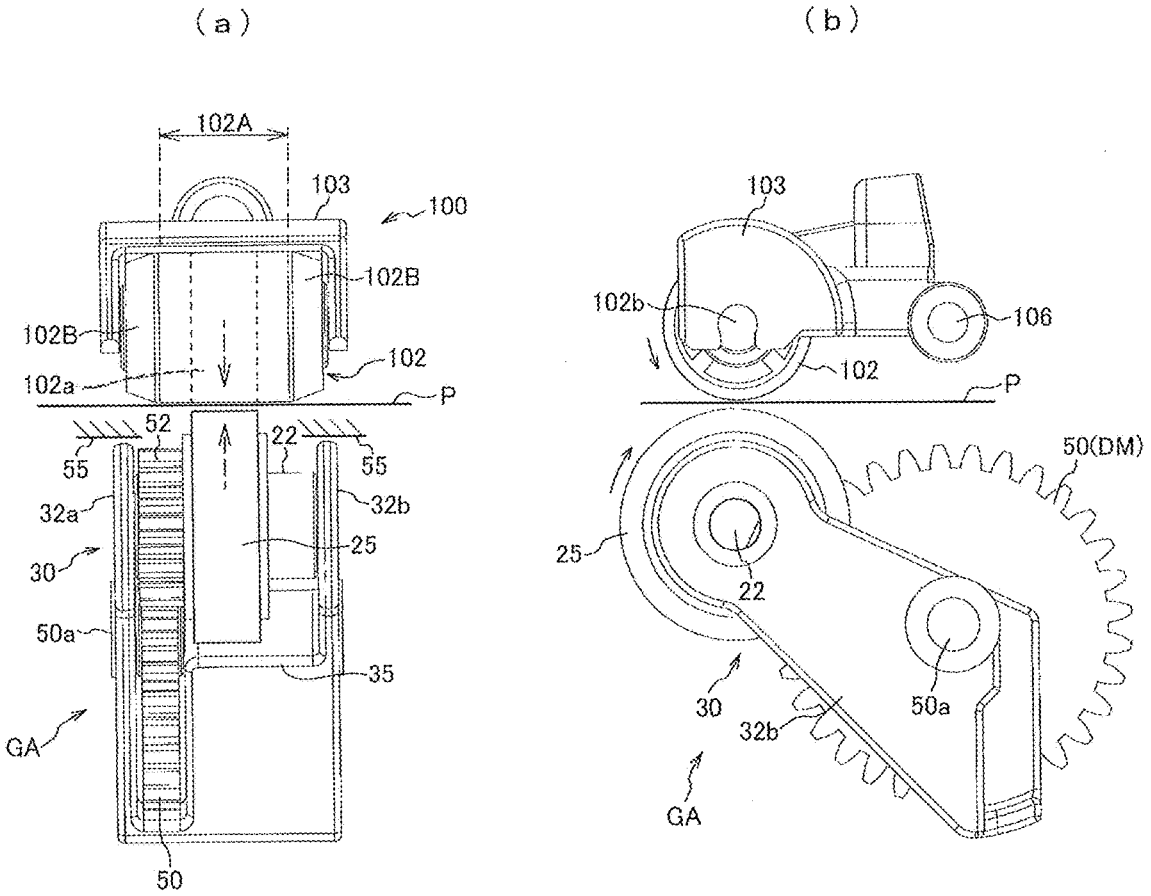
FIGS. 20(*a*) and 20(*b*) are respectively a front view and a side view of the friction transport device using the driven roller according to the modified embodiment at the time of receiving a banknote (with no transport grip).

Next, FIG. 18 is an external perspective view for explaining a configuration of the driven roller 102 according to a second embodiment (a modified embodiment) of the present invention, FIGS. 19(*a*) and 19(*b*) are respectively a front view and a side view of the friction transport device 2 using this driven roller at the time of receiving a banknote (with a strong transport grip), and FIGS. 20(*a*) and 20(*b*) are respectively a front view and a side view of the friction transport device 2 using this driven roller at the time of receiving a banknote (with no transport grip).

Constituent elements of the friction transport device 2 other than the configuration of the driven roller 102, that is, the configuration, primary actions, and effects of the transport grip adjustment mechanism GA are not different from those in the first embodiment. Therefore, only differences from the first embodiment are explained.

A principal outer circumferential surface 102A of the driven roller 102 according to the modified embodiment, which includes the axially central portion 102*a* being brough to contact with the circumferential surface of the drive roller 25 is a cylindrical body having no raised or constricted portion. That is, this driven roller does not have the protrusions 102*c* on the both end parts in the axial direction of the axially central portion 102*a* unlike the driven roller according to the first embodiment. In the present example, a tapered surface 102B having the outer diameter gradually decreasing is provided on each of the outer sides in the axial direction of the principal outer circumferential surface 102A. However, this is an example and the driven roller may be cylindrical throughout its length in the axial direction or may have a configuration in which end parts corresponding to the tapered surfaces 102B are removed.

That is, it suffices that the driven roller 102 applicable to the friction transport device 2 of the present invention is a cylindrical body (a cylindrical body with no raised or constricted portion) at least in the axially central portion 102*a* that is brought to contact with the outer circumferential surface of the drive roller. Therefore, the driven roller 102 may have the configuration including the protrusions 102*c* on the both end parts in the axial direction as in the first embodiment, or the entire principle circumferential surface 102A may be a cylindrical body with no raised or constricted portion as in the modified embodiment.

In the above configuration, when the drive roller 25 forwardly rotates to receive a banknote, the drive roller initially lifts to be in pressure contact with the axially central portion of the driven roller as in FIG. 19 and accordingly the banknote is dragged with a strong grip. However, when the transport load generated at the time of banknote transport is applied to the drive roller 25, the drive roller lowers as illustrated in FIG. 20. The difference from the first embodiment is that the transport grip is lost when a state illustrated in FIG. 20 is produced. In other words, in the first embodiment, there are two states including a state in which the transport grip is strong and a state in which the transport grip is weak, and the transport grip gradually decreases according to the amount of lowering of the drive roller. In contrast thereto, in the modified embodiment, the transport grip is either in a state in which the transport grip is strong or a state in which there is no transport grip, and there is no intermediate state in which "the transport grip gradually decreases according to the amount of lowering of the drive roller".

This feature is attributed to a fact that the protrusions 102*c* are always in contact with a banknote and generate a feeble transport grip as illustrated in FIG. 5(*b*-2) also in the state in which the drive roller is retreated and the grip is decreased at the time of forward rotation to receive the banknote in the first embodiment.

On the other hand, in the modified embodiment, the driven roller does not include the protrusions 102*c*. Accordingly, at the time of retreating of the drive roller, the device shifts to a state in which the resistance between a banknote and the driven roller is instantaneously zero or significantly low as illustrated in FIG. 20 and the transport grip is not generated. In this state, the banknote P is kept substantially linear unlike a banknote deformed in an inverted U shape in the case illustrated in FIG. 5.

When the transport grip is lost as in FIGS. 20, the transport load is not transmitted to the rollers and accordingly the device is immediately returned to the state in FIG. 19. When the state in FIG. 19 is produced, the device becomes the state in FIG. 20 due to influences of the transport load generated again. That is, while the drive roller performs widthwise shifting, skew correction, or the like of a banknote, the device is brought to the state in FIGS. 19→the state in FIGS. 20→the state in FIGS. 19→the state in FIGS. 20→ . . . , i.e., the state in which the transport grip is strong and the state in which there is no transport grip are alternated at small intervals.

In FIGS. 20, the space between the outer circumferential surfaces of the drive roller 25 and the driven roller 102 is exaggeratedly illustrated to be large for the convenience of illustration and explanation. However, the space generated in the state in FIG. 20 where there is no transport grip is actually minute and appears only for a moment. Accordingly, an actual motion of a banknote during widthwise shifting, and the transport state thereof are smooth and continuous and a banknote is not lumberingly and intermittently transported.

As illustrated in FIG. 20, with decrease of the transport grip, a banknote is enabled to sideslip or rotate in a direction different from the normal transport direction and can be subjected to widthwise shifting to the normal transport direction and the normal transport position, trajectory modification, and reformation (skew correction) to the normal transport attitude using a reaction force from a sidewall or the like. Since the operations for the reformation and correction do not involve any interruption of banknote transport, intermittent transport, or large vibration, transport that is continuous, quick, and quiet can be continued. It is needless to mention that damages on a banknote due to pressure contact with a sidewall or the like with an excessive force can also be suppressed.

That is, primary actions and effects of the first embodiment described with reference to FIG. 6 to FIG. 17 are also applicable as they are in this modified embodiment.

At the time of returning a banknote and the standby time, the state in which the transport grip is strong illustrated in FIG. 19 is maintained.

Actions and Effects of Each Embodiment

With the banknote transport device 1 according to the first and second embodiments, a banknote P inserted at various positions or angles and with various attitudes from the inlet 10*a* of the banknote transport path 10 can be corrected in the position, angle, and attitude by an action of the transport grip adjustment mechanism GA included in the friction transport device 2 during continuous transport, to be aligned with a position or attitude along the central axis of the banknote transport path 10 or one of right and left sidewalls. At this time, it is possible to prevent corner portions and other parts of the banknote from being intensely pressed against a sidewall and being dented.

That is, the transport grip adjustment mechanism GA can automatically weaken the transport grip between the drive roller and a banknote to efficiently perform the skew correction when a banknote P inserted from the inlet 10*a* is subject to a reaction force from a sidewall, and produce a state in which the transport grip is strong to advantageously perform returning transport or insertion prevention at the time of returning a banknote P or at the standby time.

The adjustment of the transport grip is realized by the transport grip adjustment mechanism GA that causes the drive roller 25 to advance or retreat with respect to the driven roller 102. That is, when a reaction force is applied in a direction different from the normal transport direction to a banknote being transported in the receiving direction, the reaction force is applied to the drive roller via the banknote and the drive roller decelerates along with the banknote. Accordingly, a difference in the rotation speed is generated between the input gear and the drive roller, whereby the drive roller revolves in a direction away from the driven roller along the outer circumference of the input gear. At this time, the transport grip decreases and attitude correction to a direction to reduce damages on the banknote from sidewalls can be performed.

The direction in which the drive roller 25 moves away from the driven roller 102 is a direction intersecting with (orthogonal to) the axial direction of the drive roller, that is, the axial direction of the shaft part 22, and the drive roller changes the distance from the circumferential surface of the driven roller without changing the axial position. In a case in which the axial position of the driven roller changes to such an extent that the transport grip adjusting function is not decreased, displacement to such an extent is allowable.

When summarized as a relation of moments, the principle of causing the drive roller (the rocking arm 30) to advance or retreat toward/from the driven roller, that is, the actuating principle of the transport grip adjustment mechanism is as follows.

That is, in a state in which a banknote is normally transported along the normal transport direction by forward rotation of the drive roller, the rocking arm 30 is pressed by the elastic biasing member 40 toward the driven roller and the drive roller is in pressure contact with the driven roller. At this time, unless the transport load (moment) L2×F2 generated during transport of a banknote exceeds the load (moment) L1×F1 from the elastic biasing member, the rocking arm does not move in the direction away from the driven roller. Meanwhile, when the transport load L2×F2 generated during transport of a banknote exceeds the load L1×F1 from the elastic biasing member due to application of a reaction force in a direction different from the normal transport direction to the banknote passing the nip part, the rocking arm lowers to actuate the transport grip adjustment mechanism, and the drive roller moves away from the driven roller.

If the drive roller does not displace in the direction (the retreating direction) away from the driven roller and the state in which the transport grip is strong is maintained, the banknote advances with a corner portion pressed against a sidewall. This causes a trouble that the corner portion is dented due to the reaction force from the sidewall, and the banknote starts advancing along the sidewall after the corner portion continues to be dented and is not dented any more. In other words, while a banknote seeks to move toward the center of the transport path due to receiving of the reaction force from the sidewall, the banknote cannot change the direction and advances straight when the transport grip is stronger than the reaction force. Accordingly, the reaction force received from the sidewall cannot be canceled and the corner portion is deformed.

After the rear end of the banknote passes the nip part between the drive roller and the driven roller, the drive roller returns to its original position.

When the drive roller moves in the retreating direction, the drive roller does not always move to the limit position and stops moving short of the limit position depending on the value of the transport load. In order to sum it up, the drive roller stops moving at a position where the load of the spring biasing by the elastic biasing member 40 toward the inner side in the axial direction is balanced against the transport load.

The friction transport device 2 can perform skew correction without causing a banknote P to be brought to intense contact with each of the sidewalls and to be deformed to a non-restorable level or to be deteriorated to other conditions.

The accuracy of authentication by the recognition sensor 17 can be enhanced by correcting the position, angle, and attitude (changing the direction) of the banknote P to be aligned with the central axis CL of the banknote transport path 10 or any one of the sidewall surfaces.

The level of alignment of banknotes passing through the friction transport device 2 and being sequentially stacked in the cashbox can be improved. Therefore, when a subsequent operation performed after a worker manually takes out the banknotes from the cashbox, for example, an operation of setting the banknotes in a sorter or a counter is to be performed, the labor to align afresh a batch of banknotes can be cut off. Since a batch of banknotes set in a sorter or the like is always aligned, occurrence of jam during processing can be prevented.

Since the sidewalls of the transport path 10 are flat surfaces and no guide rollers are provided, the transport path 10 has a simple and uncomplicated configuration including fewer components. Therefore, the transport path 10 can be manufactured at low cost and the mechanical strength can be enhanced. The flat sidewalls do not include any concave or convex portions causing jam. Since unintermittent and continuous driving is performed, transported banknotes do not flap and stable transport can be realized.

The friction transport device 2 can be applied not only to a type in which the width of the banknote transport surface, that is, the distance between the sidewalls is fixed but also to a variable width type in which the distance between the sidewalls can be changed, and can provide the skew correcting function and the like.

Summary of Configurations, Actions, and Effects of Present Invention

A friction transport device 2 according to a first invention includes: a drive-side unit 20 that transmits a transport driving force to one surface of a paper sheet transported along a transport path 10 (a transport surface 11); a drive motor 60 that supplies a driving force to the drive-side unit; a driven roller 102 (fixed in the axial position) that is arranged to oppose the drive-side unit and that followingly rotates in contact with the other surface of the paper sheet; and a transport grip adjustment mechanism GA that adjusts a transport grip between a drive roller 25 and a paper sheet.

The drive-side unit 20 includes at least one drive roller 25 that rotates (forwardly and reversely rotates) on a shaft part 22 (around the shaft part) orthogonal to a normal paper sheet transport direction, a rocking arm 30 that includes the shaft part 22 at one portion thereof and that has another portion thereof pivotally supported by a rocking shaft 50*a* so as to change a transport grip by rocking the drive roller (in a direction intersecting with or orthogonal to the shaft part 22) to change a distance from the driven roller 102, and an elastic biasing member 40 that elastically biases the drive roller toward the driven roller via the rocking arm.

The transport grip adjustment mechanism GA is configured to cause the drive roller to retreat in a direction away from the driven roller 102 against an elastic biasing force from the elastic biasing member to decrease the transport grip when transport load applied to the drive roller from the paper sheet transported on the transport path 10 by the drive roller 25 forwardly rotating changes beyond a predetermined value (when an external force above a predetermined value in a direction other than the normal transport direction is applied to the paper sheet).

According to the present invention, a configuration to automatically change the friction force (transport grip) between the drive roller and a paper sheet is realized only by a mechanical structure without the need of detection by a sensor or software control.

With decrease of the transport grip to eliminate constraint by the nip part or reduce the constraint, a paper sheet is enabled to sideslip or rotate in a direction different from the normal transport direction, and can be subjected to widthwise shifting to the normal transport direction and the normal transport position, trajectory modification, and reformation (skew correction) to the normal transport attitude using a reaction force from a sidewall or the like. Since the operations for the reformation and correction do not involve any interruption of banknote transport or intermittent transport, continuous and quick transport can be continued.

As for the relation to Patent Literature 3, according to the invention of the present application, the number of components is smaller and the device can be downsized. Since the drive roller only moves in the upper and lower directions and the drive roller does not axially move with respect to the driven roller to rub thereon unlike in the friction transport device of Patent Literature 3, decrease in the durability due to wear of rollers can be prevented. Furthermore, in the invention of the present application, design flexibility in the diameters and widths of the drive roller and the driven roller, multiple arrangement thereof, and the like is improved.

In the friction transport device 2 of a second invention, the transport path 10 includes sidewalls 11A, 11B, 12, 13, and 14, and the transport grip adjustment mechanism GA decreases the transport grip when the paper sheet is brought to contact with one of the sidewalls in a course of transport along the transport path and is subject to an external force above the predetermined value in a direction other than the normal paper sheet transport direction. The decreased value of the transport grip is a value that enables the paper sheet to sideslip between the drive roller and the driven roller.

As a result of sideslip of a paper sheet, it is possible to perform skew correction of shifting the paper sheet to the central axis of the transport path or one of the sidewalls while correcting the transport attitude of the paper sheet to be in parallel to the normal paper sheet transport direction by changing the transport attitude to a direction to cancel an external force from one of the sidewalls in cooperation with the sidewall.

In the friction transport device 2 according to a third invention, the transport grip adjustment mechanism GA includes the rocking arm 30 that rocks on the rocking shaft 50*a*, the elastic biasing member 40, an input gear 50 that is pivotally supported to be rotatable about the rocking shaft 50*a* and that rotates upon reception of the driving force from the drive source 60, an output gear 52 that is coaxially integrated with the drive roller 25 and that meshes with the input gear 50 to receive transmission of a driving force, and a stopper member 55 that defines an upper limit position (a forward rotation limit position) of the rocking arm, and the output gear is capable of revolving on an outer circumference of the input gear according to increase or decrease of load applied to the drive roller.

Accordingly, a configuration in which the rocking arm retreats highly responsive to increase in the load applied to the drive roller can be constructed.

In the friction transport device 2 according to a fourth invention, the output gear 52 rocks the rocking arm 30 in a direction to cause the rocking arm to be in pressure contact with the stopper member 55 when transport load equal to or above a predetermined value is applied to the paper sheet positioned between the drive roller 25 and the driven roller 102 at a time of reverse rotation of the drive roller.

The transport grip is intensified by the transport load in the reverse transport direction and the elastic biasing force of the elastic biasing member.

When a foreign material other than a normal banknote is inserted into a paper sheet handling device operating in the market, reliable discharge of the foreign material at an early stage after the insertion to prevent the device from stopping due to an error or jam caused by the foreign material is demanded by users. The present invention can meet this market demand.

In the friction transport device 2 according to a fifth invention, the driven roller 102 is a cylindrical body (having a constant diameter in the axial direction) at least at an axially central portion 102*a* being in contact with an outer circumferential surface of the drive roller 25.

Portions other than the axially central portion, which are not brought to contact with the outer circumferential surface of the drive roller may be the protrusions (ridges) 102*c*, or may be non-protruded portions as in the modified embodiment illustrated in FIGS. 19 and 20. That is, the principal outer circumferential surface 102A including the axially central portion 102*a* may be a cylindrical body having no raised or constricted portions.

Since the driven roller according to the first embodiment has the protrusions 102*c* on the both outer sides of the axially central portion 102*a*, the transport grip gradually decreases between the state in which the transport grip is strong and the state in which the transport grip is weak according to the amount of lowering of the drive roller. On the other hand, since the protrusions are not included in the modified embodiment, the states in which the transport grip is strong and the state in which there is no transport grip alternately occur at small intervals and the actual motion and transport state of a banknote during widthwise shifting are smooth and continuous.

A paper sheet transport device according to the present invention includes the friction transport device according to any one of inventions 1 to 5, a paper sheet detection sensor 15 that detects entry of a paper sheet into the transport path 10, and a control unit 200 that controls the drive motor, and the control unit actuates the drive source to forwardly rotate the drive roller 25 based on a paper sheet entry detection signal from the paper sheet detection sensor.

A paper sheet transport device such as various types of vending machines, a change machine, or a cash dispenser can enhance each of the skew correcting function with decrease of the transport grip at the time of occurrence of skew, the returning capability with increase in the transport grip, and the paper sheet insertion preventing capability, which are included in all the friction transport devices described above.

REFERENCE SIGNS LIST

1 . . . banknote (paper sheet) transport device, 2 . . . friction transport device, 3 . . . lower unit, 4 . . . upper unit, 10 . . . banknote transport path (transport path), 10*a* . . . inlet, 11 . . . banknote transport surface, 11A, 11B . . . sidewall, 11*a* . . . inlet-side transport surface, 11*b* . . . intermediate transport surface, 11*c* . . . back transport surface, 12 . . . inlet-side sidewall, 13 . . . intermediate sidewall, 14 . . . back sidewall, 15 . . . paper sheet detection sensor (inlet sensor), 16*a*, 16*b* . . . transport roller, 17 . . . recognition sensor, 20 . . . drive-side unit, 22 . . . shaft part, 25 . . . drive roller, 30 . . . rocking arm, 32 . . . arm member, 32*a*, 32*b* . . . arm member, 35 . . . gear supporting member, 40 . . . elastic biasing member, 40*a* . . . central portion, 40*b* . . . arm, 40*c* . . . arm, 50 . . . input gear, 50*a* . . . rocking shaft, 52 . . . output gear, 55 . . . stopper member, 60 . . . drive motor, 62 . . . drive transmission member, 100 . . . driven-side unit, 102 . . . driven roller, 102*a* . . . central recessed portion (recessed part), 102*b* . . . shaft part, 102*c* . . . protrusion, 103 . . . holding member, 106 . . . shaft, 107 . . . elastic member, 200 . . . control unit, DM . . . drive transmission mechanism, GA . . . transport grip adjustment mechanism.

The invention claimed is:

1. A friction transport device comprising:

a drive-side unit that transmits a transport driving force to one surface of a paper sheet transported along a transport path; and a drive motor that supplies a driving force to the drive-side unit; a driven roller that is arranged to oppose the drive-side unit and that followingly rotates in contact with the other surface of the paper sheet wherein the drive-side unit includes;

a drive roller that rotates on a shaft part orthogonal to a normal paper sheet transport direction, and a transport grip adjustment mechanism comprising:

a rocking arm that includes the shaft part at one portion thereof and that has another portion thereof pivotally supported by a rocking shaft so as to change a transport grip by rocking the drive roller to change a distance from the driven roller, and an elastic biasing member that elastically biases the drive roller toward the driven roller via the rocking arm, an input gear that is pivotally supported to be rotatable about the rocking shaft and that rotates upon reception of the driving force from the drive motor, an output gear that is coaxially integrated with the drive roller and that meshes with the input gear to receive transmission of a driving force, and a stopper member that defines an upper limit position of the rocking arm, wherein:

the output gear is capable of revolving on an outer circumference of the input gear according to increase or decrease of load applied to the drive roller, and the output gear rocks the rocking arm in a direction to cause the rocking arm to be in pressure contact with the stopper member when transport load equal to or above a predetermined value is applied to the paper sheet positioned between the drive roller and the driven roller at a time of reverse rotation of the drive roller, and wherein the transport grip adjustment mechanism is configured to cause the drive roller to retreat in a direction away from the driven roller against a biasing force from the elastic biasing member to decrease the transport grip when transport load applied to the drive roller from the paper sheet transported on the transport path by the drive roller forwardly rotating changes beyond a predetermined value.

2. The friction transport device according to claim 1, wherein the transport path includes a sidewall, wherein the transport grip adjustment mechanism decreases the transport grip when the paper sheet is brought to contact with the sidewall in a course of transport on the transport path by the drive roller forwardly rotating and is subject to an external force above the predetermined value in a direction other than the normal paper sheet transport direction, and wherein a decreased value of the transport grip is a value that enables the paper sheet to sideslip between the drive roller and the driven roller to enable correction of a transport attitude of the paper sheet to be in parallel to the normal paper sheet transport direction by changing the transport attitude in a direction to cancel an external force from the sidewall in cooperation with the sidewall.

3. The friction transport device according to claim 2, wherein the driven roller is a cylindrical body at least at an axially central portion being in contact with an outer circumferential surface of the drive roller.

4. The friction transport device according to claim 1, wherein the driven roller is a cylindrical body at least at an axially central portion being in contact with an outer circumferential surface of the drive roller.

5. A paper sheet transport device comprising:

a friction transport device comprising:

a drive-side unit that transmits a transport driving force to one surface of a paper sheet transported along a transport path; and a drive motor that supplies a driving force to the drive-side unit; a driven roller that is arranged to oppose the drive-side unit and that followingly rotates in contact with the other surface of the paper sheet wherein the drive-side unit includes:

a drive roller that rotates on a shaft part orthogonal to a normal paper sheet transport direction, and a transport grip adjustment mechanism comprising:

a rocking arm that includes the shaft part at one portion thereof and that has another portion thereof pivotally supported by a rocking shaft so as to change a transport grip by rocking the drive roller to change a distance from the driven roller, and an elastic biasing member that elastically biases the drive roller toward the driven roller via the rocking arm, an input gear that is pivotally supported to be rotatable about the rocking shaft and that rotates upon reception of the driving force from the drive motor, an output gear that is coaxially integrated with the drive roller and that meshes with the input gear to receive transmission of a driving force, and a stopper member that defines an upper limit position of the rocking arm, wherein:

the output gear is capable of revolving on an outer circumference of the input gear according to increase or decrease of load applied to the drive roller, and the output gear rocks the rocking arm in a direction to cause the rocking arm to be in pressure contact with the stopper member when transport load equal to or above a predetermined value is applied to the paper sheet positioned between the drive roller and the driven roller at a time of reverse rotation of the drive roller, and wherein the transport grip adjustment mechanism is configured to cause the drive roller to retreat in a direction away from the driven roller against a biasing force from the elastic biasing member to decrease the transport grip when transport load applied to the drive roller from the paper sheet transported on the transport path by the drive roller forwardly rotating changes beyond a predetermined value;

a paper sheet detection sensor that detects entry of a paper sheet into the transport path; and a control unit that controls the drive motor, wherein the control unit actuates the drive motor to forwardly rotate the drive roller based on a paper sheet entry detection signal from the paper sheet detection sensor.

6. The friction transport device according to claim 5, wherein the transport path includes a sidewall, wherein the transport grip adjustment mechanism decreases the transport grip when the paper sheet is brought to contact with the sidewall in a course of transport on the transport path by the drive roller forwardly rotating and is subject to an external force above the predetermined value in a direction other than the normal paper sheet transport direction, and wherein a decreased value of the transport grip is a value that enables the paper sheet to sideslip between the drive roller and the driven roller to enable correction of a transport attitude of the paper sheet to be in parallel to the normal paper sheet transport direction by changing the transport attitude in a direction to cancel an external force from the sidewall in cooperation with the sidewall.

7. The friction transport device according to claim 5, wherein the driven roller is a cylindrical body at least at an axially central portion being in contact with an outer circumferential surface of the drive roller.

* * * * *